US006820836B2

(12) United States Patent
Sato et al.

(10) Patent No.: US 6,820,836 B2
(45) Date of Patent: Nov. 23, 2004

(54) FIBERBOARD SPLICE APPARATUS, CORRUGATE MACHINE AND FIBERBOARD FEED METHOD

(75) Inventors: Hiroshi Sato, Hiroshima-ken (JP); Hiroaki Sasashige, Hiroshima-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 7 days.

(21) Appl. No.: 10/115,259

(22) Filed: Apr. 4, 2002

(65) Prior Publication Data

US 2003/0080235 A1 May 1, 2003

(30) Foreign Application Priority Data

Oct. 25, 2001 (JP) ..... 2001-327814

(51) Int. Cl.[7] ..... B65H 19/18; B65H 19/20

(52) U.S. Cl. ..... 242/551; 242/554.2; 242/556.1; 242/562.1; 156/504

(58) Field of Search ..... 242/551, 552, 242/553, 554.2, 556.1, 562, 562.1, 554; 156/159, 502, 504

(56) References Cited

U.S. PATENT DOCUMENTS

| | | | | |
|---|---|---|---|---|
| 3,635,417 A | * | 1/1972 | Kajiwara et al. | 242/562 |
| 4,984,750 A | * | 1/1991 | Shigeta et al. | 242/553 |
| 5,167,376 A | * | 12/1992 | Boldrini et al. | 242/562 |
| 5,249,754 A | * | 10/1993 | Liermann et al. | 242/562 |
| 5,328,114 A | * | 7/1994 | Boldrini et al. | 242/562 |
| 5,437,749 A | * | 8/1995 | Pipkorn et al. | 242/554.2 |
| 5,947,408 A | | 9/1999 | Miyake | |
| 6,237,870 B1 | * | 5/2001 | Kawamura | 242/562 |

FOREIGN PATENT DOCUMENTS

| | | |
|---|---|---|
| EP | 0 181 280 | 5/1986 |
| JP | 61-111264 | 5/1986 |
| JP | 2-10342 | 1/1990 |
| JP | 4-12445 | 1/1992 |
| JP | 10-157892 | 6/1998 |
| JP | 10-181962 | 7/1998 |
| JP | 11-227994 | 8/1999 |
| JP | 2000-351495 | 12/2000 |

OTHER PUBLICATIONS

Copy of Japanese Office Action dated Jan. 28, 2004, for Japanese Patent Application No. 2001–327814, pp. 1 and 2, both Japanese and English language.

* cited by examiner

*Primary Examiner*—John M. Jillions
(74) *Attorney, Agent, or Firm*—Armstrong, Kratz, Quintos, Hanson & Brooks, LLP

(57) ABSTRACT

A fiberboard splice apparatus is made up of a fiberboard splice part for adhering an old fiberboard fed from one roll fiberboard to an end portion of a new fiberboard fed from the other roll fiberboard to accomplish fiberboard splice therebetween, and a fiberboard feed device for forwarding the new fiberboard from the other roll fiberboard to the fiberboard splice part. The fiberboard feed device includes one fiberboard feed roll placed along an axial direction of the roll fiberboard to make the other roll fiberboard rotatable in a state brought into contact with a surface of the other roll fiberboard and a pair of pickup members located to interpose the fiberboard feed roll therebetween for picking up a tip portion of the other roll fiberboard while coming into sliding contact with the surface of the other roll fiberboard.

19 Claims, 13 Drawing Sheets

FIBERBOARD SPLICE APPARATUS, CORRUGATE MACHINE AND FIBERBOARD FEED METHOD

BACKGROUND OF THE INVENTION (1) Field of the Invention

The present invention relates to a fiberboard (fibreboard) splice apparatus, a corrugate machine including this fiberboard splice apparatus, and a fiberboard feed method, and more particularly to a fiberboard splice apparatus, a corrugate machine including this fiberboard splice apparatus, and a fiberboard feed method, which are suitable for automatization of a preparatory process for fiberboard splice.

(2) Description of the Related Art

FIG. 14 is an illustration of a mechanical construction of a single facer part of a corrugate machine which produces a corrugated fiberboard sheet.

As FIG. 14 shows, mill roll stands 52, which are made to unwind (unroll) roll fiberboard (rolled base paper) 53 and 54 for fiberboard supply, being located before and after a single facer 51 [that is, on the upstream and downstream sides in a web conveying direction (web advancing direction)]. The roll fiberboard 53 is paper put presently in use for production, while the roll fiberboard 54 is paper placed in a stand-by condition to be fed immediately to the single facer 51 in place of the roll fiber board 53 in the case of an exhaustion of the roll fiberboard or a fiberboard replacement involved in an order change. At the replacement (interchange) of the roll fiberboard 53 with the roll fiberboard 54, a fiberboard splice apparatus 56 joints or connects the front end (tip) portion of a new fiberboard (fiberboard to be supplied from the roll fiberboard 54; new web) to the rear end portion of the old fiberboard (fiberboard to be fed from the roll fiberboard 53; old web) in an overlapped condition.

Secondly a description will be given hereinbelow of the outline of the fiberboard splice apparatus 56.

As FIG. 14 shows, the fiberboard splice apparatus 56 is located on a bridge 55 installed to extend above the mill roll stands 52 and the single facer 51. In this fiberboard splice apparatus 56, a fiberboard splice unit 60 is situated to be movable in the web conveying direction. That is, the fiberboard splice unit 60 is placed to be movable from the upstream side to the downstream side in the web advancing direction. In general, in the splice works, the fiberboard splice unit 60 is shifted to a predetermined position above the new fiberboard (in this case, the fiberboard to be supplied from the roll fiberboard 54). Incidentally, although a dancer roll and others are incorporated into the fiberboard splice apparatus 66, they are omitted here from the illustration.

In addition, referring to FIG. 15, a detailed description will be given hereinbelow of the fiberboard splice unit 60.

As FIG. 15 shows, upper and lower guide rolls 62 and 63 are set on both side frames 61 of the fiberboard splice unit 60 extending in a web cross direction. On an inner side of the frame 61, there are set a pair of frames 64*a* and 64*b* made to rock around an axis X of the upper guide roller 62, and to these frames 64*a* and 64*b*, there are respectively attached fixed stop bars 66*a*, 66*b*, movable stop bars 67*a*, 67*b*, pressing bars 68*a*, 68*b* and knives 69*a*, 69*b*. These will collectively be referred to hereinafter as fiberboard splice parts 65*a* and 65*b*.

Additionally, a suction device (not shown) is built in the pressing bars 68*a* and 68*b* to provide a function to suck and hold a new fiberboard (new web) forwarded from a roll fiberboard. In the illustration, the new fiberboard 54*a* is sucked and held by the pressing bar 68*b*.

As FIG. 15 shows, as this fiberboard splice parts 65*a* and 65*b*, two sets of fiberboard splice parts are located symmetrically in conjunction with the roll fiberboard 53 [old fiberboard (old web) 53*a*] and the roll fiberboard 54 [new fiberboard (new web) 54*a*], respectively. In this illustration, the old web 53*a* from the roll fiberboard (old roll fiberboard) 53 unrolled travels on one fiberboard splice part 65*a* side while the new web 54*a* from the roll fiberboard (new roll fiberboard) 54 unrolled is in the stand-by condition on the other fiberboard splice part 65*b* side. Additionally, a pressure sensitive adhesive double coated tape 70 is adhered onto the tip portion of the new web 54*a*.

Furthermore, a brief description will be given hereinbelow of the fiberboard splice process.

First of all, in response to a fiberboard splice command, the movable stop bar 67*a* of the fiberboard splice part 65*a* is shifted to hold the old web 53*a* together with the fixed stop bar 66*a* to stop the traveling of the old web 53*a*. Following this, both the fiberboard splice parts 65*a* and 65*b* are rotated to cause the pressing bars 68*a* and 68*b* to approach each other and finally come into contact with each other so that the adhesion between the new and old webs 53*a* and 54*a* takes place through the use of the pressure sensitive adhesive double coated tape 70. Then, the knife 69*a* of the fiberboard splice part 65*a* is actuated to cut the old web 53*a*. Thereafter, an acceleration roll 71 makes the new web 54*a*, being in a stopping state after the fiberboard splice, travel while accelerated, thus returning to the ordinary operating condition.

Although the above description involves the fiberboard splice process after the pressure sensitive adhesive double coated tape 70 is attached onto the front end portion of the new web 54*a* and the new web 54*a* is held on the pressing bar 68*b*, a preparatory process is necessary before this state.

This preparatory process will be described hereinbelow with reference to FIGS. 16A to 16D.

First of all, as shown in FIG. 16A, a new roll fiberboard (roll fiberboard for feeding a new web 54*a*) 54 is put on a fiberboard supply carriage 57 to be carried into a predetermined position between arms 52*a* and 52*a* of a mill roll stand 52. The front end portion of the new roll fiberboard 54 is fixed with a tape 58 to prevent the new roll fiberboard 54 from getting loose during conveyance.

Secondly, as shown in FIG. 16B, when the new roll fiberboard 54 has been carried into the predetermined position, the arms 52*a* and 52*a* of the mill roll stand 52 chuck the new roll fiberboard 54 with their end portions and lifts the new roll fiberboard 54 so that the new web 54*a* can be drawn out therefrom.

Following this, an operator peels the tape 58 or cuts it, and then, as shown in FIG. 16C, the tip portion of the new roll fiberboard 54 is pulled out to take out the new web 54*a* and is introduced through a predetermined roll up to the fiberboard splice part 65*b* of the fiberboard splice unit 60.

In this case, for easy preparatory work, the fiberboard splice part 65*b* of the fiberboard splice unit 60 is pushed down to a position indicated by a two-dot chain line in FIG. 15. In this connection, the position indicated by a solid line in FIG. 15 is referred to as a "stand-by position", while the position indicated by the two-dot chain line in the illustration is called the "preparatory position".

Furthermore, as shown in FIG. 16D, the new web 54*a* introduced into the fiberboard splice part 65*b* is guided through the guide roll 62, the fixed stop bar 66*b* and the knife 69*b* to the pressing bar 68*b,* and the tip portion thereof is cut to remove the fiberboard of a predetermined appropriate length (for example, approximately one turn of the fiberboard roll). The cut tip portion is held by the pressing bar 68*b* and the pressure sensitive adhesive double coated tape 70 is adhered onto a surface thereof. Thereafter, as indicated by the solid line in FIG. 15, the frame 64*b* is rotated up to the normal stand-by position, at which the preparation (setup) for the fiberboard splice process reaches completion.

In this case, the tip portion of the new web 54*a,* for example, corresponding to approximately one turn of a roll fiberboard, is abandoned. This is because, when the tape 58 is peeled or cut, the new web 54*a* can get torn at the position corresponding to one turn of the fiberboard or a portion of the tape 58 can be left. In addition, for example, during the storage, a surface of the fiberboard can get torn or its moisture or the like can vary abnormally, and in such a case, the fiberboard may be cut to remove the fiberboard of a length corresponding to more-than one turn.

Meanwhile, in the above-mentioned preparation for the fiberboard splice process, an operator manually conducts the following operations: that is, after the new roll fiberboard 54 is chucked by the mill roll stand 52, not only the tape 58 is peeled but also the tip portion of the new web 54*a* fed from the new roll fiberboard 54 is forwarded to run over the pressing bar 68*b* and is cut and even the pressure sensitive adhesive double coated tape 70 is attached onto the cut portion.

However, since such manual operations take time in the preparatory stage for the fiberboard splice process, difficulty is experienced in enhancing the machine availability factor. Particularly, for example, in a case in which the replacement of roll fiberboard is frequent according to various orders, the improvement of the machine availability factor becomes difficult and a large burden is imposed on the operator.

SUMMARY OF THE INVENTION

The present invention has been developed in view of the above-mentioned problems, and it is therefore an object of the invention to provide a fiberboard splice apparatus, a corrugate machine equipped with this fiberboard splice apparatus, and a fiberboard feed method, which are capable of shortening the time to be taken for the preparation for the fiberboard splice process to enhance the machine availability factor by eliminating the manual operation in the preparation for the fiberboard splice process for increasing the rate of the automatization (that is, by enhancing the rate of automatization for taking a step toward the full automation).

For this purpose, a fiberboard splice apparatus according to the present invention comprises a fiberboard splice part for adhering an old fiberboard fed from one roll fiberboard to an end portion of a new fiberboard fed from the other roll fiberboard to accomplish fiberboard splice therebetween and a fiberboard feed device for forwarding the new fiberboard, fed by unrolling the other roll fiberboard, to the fiberboard splice part, wherein the fiberboard feed device includes a fiberboard feed roll placed along an axial direction of the roll fiberboard to make the other roll fiberboard rotatable in a state brought into contact with a surface of the other roll fiberboard, and a pair of pickup (catch) members located to interpose the fiberboard feed roll for picking up a tip portion of the other roll fiberboard while coming into sliding contact with a surface of the other roll fiberboard.

The fiberboard splice apparatus according to the present invention can eliminate the manual operation in the preparation for the fiberboard splice process to enhance the rate of the automation; in consequence, it is possible to shorten the time to be needed for the preparation for the fiberboard splice process and to enhance the machine availability factor. Add to it that, since the bidirectional unrolling can automatically be made with such simple means as to rock the fiberboard feed roll or the like, the automatization of the fiberboard splice apparatus is realizable at a low cost.

Preferably, a rocking means is provided to rock the fiberboard feed roll and the pickup member up to a predetermined position in accordance with the unrolling direction of the other roll fiberboard.

In addition, preferably, the rocking means is composed of a rocking frame made rockable, a rocking frame actuator for rocking the rocking frame and a control means for controlling the rocking frame actuator.

Still additionally, it is also appropriate that a pickup member rocking means is provided to rock the pickup member independently with respect to the fiberboard feed roll.

Yet additionally, the pickup member rocking means is composed of a pickup member supporting member made rockable, a supporting member actuator for rocking the pickup member supporting member, and a control means for controlling the supporting member actuator.

Moreover, the pickup member rocking means is equipped with a fiberboard detection sensor for detecting the tip portion of the other roll fiberboard picked up by the pickup member.

Still moreover, the pickup member is made up of a finger having a function to pick up the tip portion of the other roll fiberboard and a function to guide the new fiberboard fed from the other roll fiberboard, and a cutter having a function to pickup the tip portion of the other roll fiberboard and a function to cut a tape used for adhering the tip portion of the other roll fiberboard to a roll outer circumferential surface.

In this case, the finger is constructed as a flat-plate-like member extending along a cross direction of the other roll fiberboard, and the cutter is made so that its tip portion has a function to cut the tape and made to be movable in the cross direction of the other roll fiberboard.

Furthermore, the fiberboard splice apparatus further comprises a fiberboard detection sensor for sensing the tip portion of the other roll fiberboard picked up by the pickup member, a cutter actuator for shifting the cutter in a cross direction of the other roll fiberboard, a fiberboard feed roll actuator for rotating the fiberboard feed roll, and control means for issuing a control signal for operating each of the cutter actuator and the fiberboard feed roll actuator, with the control means, when the fiberboard detection sensor senses the tip portion of the roll fiberboard, issuing a signal to the fiberboard feed roll actuator for stopping the rotation of the fiberboard feed roll and further issuing a signal to the cutter actuator to shift the cutter in the cross direction of the other roll fiberboard for cutting the tape used for adhering the tip portion of the other roll fiberboard to the roll outer circumferential surface thereof.

Still furthermore, the fiberboard splice apparatus further comprises a fiberboard feed roll actuator for rotationally driving the fiberboard feed roll and a clutch designed to make connection and disconnection of a driving force from the fiberboard feed roll actuator.

In addition, the fiberboard splice apparatus further comprises a pair of roll supporting frames for supporting the fiberboard feed roll at their end portions and guide members fixedly secured to the roll supporting frames to guide, to the fiberboard splice part, the other roll fiberboard picked up by the pickup member.

Still additionally, the fiberboard splice apparatus further comprises a tape detection sensor for detecting the presence of the tape used for adhering the tip portion of the other roll fiberboard to the roll outer circumferential surface, a fiberboard feed roll actuator for rotating the fiberboard feed roll and control means for outputting a control signal for operating the fiberboard feed roll actuator, with the control means, when the presence of the tape is sensed by the tape detection sensor, driving the fiberboard feed roll actuator to set a rotational speed of the fiberboard feed roll at a value below a predetermined rotational speed.

Yet additionally, a fiberboard end processing device is provided to cut the new fiberboard, fed by the fiberboard feed device, by a predetermined length from its tip portion.

Moreover, a tape adhering device is provided to adhere a pressure sensitive adhesive double coated tape onto an end portion of the new fiberboard.

Furthermore, a fiberboard splice apparatus comprises a fiberboard splice part for adhering an old fiberboard fed from one roll fiberboard to an end portion of a new fiberboard fed from the other roll fiberboard to accomplish fiberboard splice therebetween and a fiberboard feed device for forwarding the new fiberboard, fed by unrolling the other roll fiberboard, to the fiberboard splice part, wherein the fiberboard feed device includes one fiberboard feed roll placed along an axial direction of the roll fiberboard, a pair of pickup members located to interpose the fiberboard feed roll therebetween for picking up a tip portion of the other roll fiberboard, a fiberboard feed roll actuator for rotationally driving the fiberboard feed roll, and control means for controlling the fiberboard feed roll actuator, with the fiberboard feed roll being rotated by the fiberboard feed roll actuator in accordance with a control signal from the control means for fiberboard feeding in a state where the fiberboard feed roll and the pickup member are brought into contact with a surface of the other roll fiberboard.

The fiberboard splice apparatus according to the present invention can eliminate the manual operation in the preparation for the fiberboard splice process to enhance the rate of the automation; in consequence, it is possible to shorten the time to be needed for the preparation for the fiberboard splice process and to enhance the machine availability factor. Add to it that, since the bidirectional unrolling can automatically be made with such simple means as to rock the fiberboard feed roll or the like, the automatization of the fiberboard splice apparatus is realizable at a low cost.

A corrugate machine according to the present invention is characterized by comprising the above-mentioned fiberboard splice apparatus.

The corrugate machine according to the present invention can eliminate the manual operation in the preparation for the fiberboard splice process to enhance the rate of the automation; in consequence, it is possible to shorten the time to be needed for the preparation for the fiberboard splice process and to enhance the machine availability factor. Add to it that, since the bidirectional unrolling can automatically be made with such simple means as to rock the fiberboard feed roll or the like, the automatization of the fiberboard splice apparatus is realizable at a low cost.

Furthermore, in accordance with the present invention, there is provided a fiberboard feed method of feeding a new fiberboard to a fiberboard splice part for adhering an old fiberboard fed from one roll fiberboard to an end portion of the new fiberboard fed from the other roll fiberboard to accomplish fiberboard splice therebetween, comprising a first step of rocking one fiberboard feed roll and a pair of pickup members located to interpose the fiberboard feed roll in accordance with an unrolling direction of the other roll fiberboard and of rocking the pickup member independently of the fiberboard feed roll, and a second step of picking up a tip portion of the other roll fiberboard to feed the tip portion to the fiberboard splice part while rotating the other roll fiberboard through the use of the fiberboard feed roll in a state where the fiberboard feed roll and the pickup member are brought into contact with a surface of the other roll fiberboard.

The fiberboard feed method according to the present invention can eliminate the manual operation in the preparation for the fiberboard splice process to enhance the rate of the automation; in consequence, it is possible to shorten the time to be needed for the preparation for the fiberboard splice process and to enhance the machine availability factor. Add to it that, since the bidirectional unrolling can automatically be made with such simple means as to rock the fiberboard feed roll or the like, the automatization of the fiberboard splice apparatus is realizable at a low cost.

Preferably, in the first step, in a case in which the other roll fiberboard is in a face-winding condition in which a fiberboard is wound in a state where its fiberboard face constitutes an outer surface, the fiberboard feed roll is brought into contact with a surface of the other roll fiberboard to reach a first position and the tip portion of the one pickup member is brought into contact with the surface of the other roll fiberboard, while, in the case in which the other roll fiberboard is in a back-winding condition in which a fiberboard is wound in a state where its fiberboard back constitutes an outer surface, the fiberboard feed roll is brought into contact with a surface of the other roll fiberboard to reach a second position different from the first position and the tip portion of the other pickup member is brought into contact with the surface of the other roll fiberboard.

In addition, preferably, in the second step, a tape used for adhering the tip portion of the other roll fiberboard to the roll outer circumferential surface is cut in a state where the other roll fiberboard is picked up.

DESCRIPTION OF THE PREFERRED EMBODIMENTS

Figure 1:
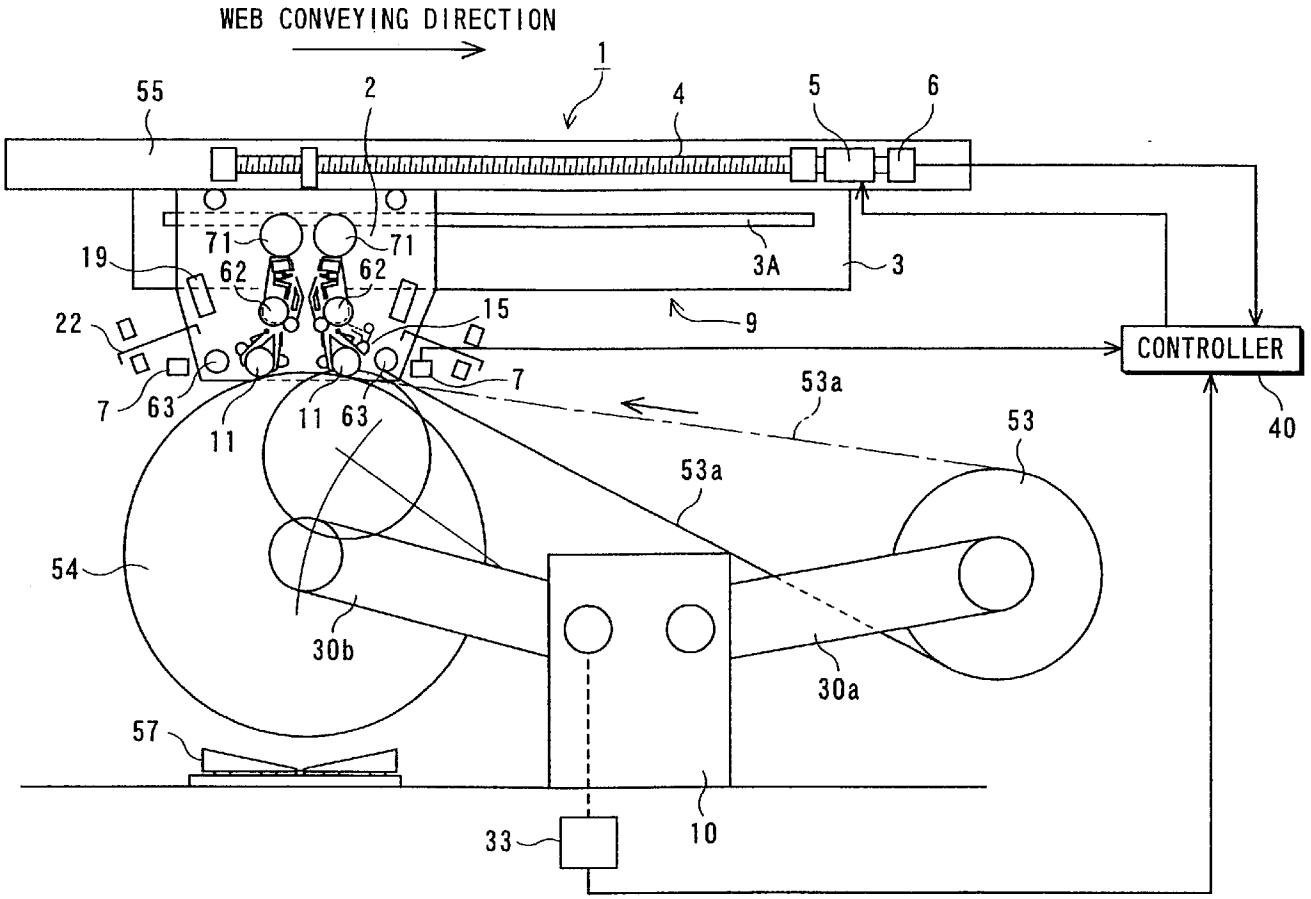
FIG. 1 illustratively shows the entire construction of a fiberboard splice apparatus included in a corrugate machine according to an embodiment of the present invention.

Referring to the drawings, a detailed description will be given hereinbelow of a fiberboard splice apparatus, a corrugate machine equipped with this fiberboard splice apparatus and a fiberboard feed method according to an embodiment of the present invention.

As already described above as the conventional technique (see FIG. 14), the fiberboard splice apparatus according to this embodiment is installed, for example, before and after a single facer 1 in a corrugate machine, that is, on the upstream and downstream sides in a web advancing direction (web conveying direction).

A feature of this embodiment is to enable the automatization of preparation for a fiberboard splice process to be conducted by this fiberboard splice apparatus.

Secondly, this fiberboard splice apparatus will be described hereinbelow with reference to FIGS. 1 to 10.

As FIG. 1 shows, the fiberboard splice apparatus, designated generally at reference numeral 1, is mounted on a bridge 55 extending along the web conveying direction above a mill roll stand (which is equally referred to as a roll stand) 10 equipped with an arm 30*a* for supporting an old roll fiberboard 53 and an arm 30*b* for supporting a new roll fiberboard 54. The fiberboard splice apparatus 1 comprises a fiberboard splice unit 2 and further comprises a fiberboard splice unit moving device 9, for moving the fiberboard splice unit 2, including a fiberboard splice unit supporter 3 including a screw (threaded) shaft 4, a motor 5 and a rail 3A serving as a guide member for guiding the fiberboard splice unit 2.

The fiberboard splice unit 2 is supported by the fiberboard splice unit supporter 3 to be movable along the web conveying direction (web flowing direction) in a state guided by the rail 3A.

The screw shaft 4 operatively connected to the motor 5 is fitted in the fiberboard splice unit 2 so that the rotation of the screw shaft 4 by the motor 5 causes parallel movement of the fiberboard splice unit 2 on the rail 3A along the web conveying direction. Additionally, the information (for example, the speed of rotation) about the rotation of the motor 5 (that is, the rotation of the screw shaft 4) is read by a rotary encoder 6, which enables precise understanding of the position of the fiberboard splice unit 2.

The motor 5 is made to operate in accordance with a control signal from a controller (control means) 40. The information from the rotary encoder 6 is sent to the controller 40.

Furthermore, on the fiberboard splice unit 2, there is mounted a photoelectric (tube) detector (roll fiberboard detection sensor) 7 for sensing an outer-diameter portion of the new roll fiberboard (the other roll fiberboard) 54 (in this case, an upper surface portion of the roll fiberboard 54). Thus, it is possible to accurately set the relative position of the new roll fiberboard 54 with respect to the fiberboard splice unit 2 on the basis of the detection information from the photoelectric detector 7.

The reason for accurately setting the relative position of the new roll fiberboard 54 to the fiberboard splice unit 2 is that the diameter of the new roll fiberboard 54 is not constant. That is, in general, since the corrugate machine is used according to a small order, the fiberboard replacement is done halfway before the roll fiberboard is not completely used up. In this case, the remaining roll fiberboard is kept and again put to use. This means that the remaining roll fiberboard may be used as a new roll fiberboard. For this reason, the diameter of the new roll fiberboard 54 set on the mill roll stand 10 ranges widely from a large diameter in a completely new condition to a small diameter in a little-left condition.

Concretely, as FIG. 1 shows, when the new roll fiberboard 54 chucked by the arm 30*b* of the mill roll stand 10 is lifted and an outer-diameter portion of the new roll fiberboard 54 (an upper surface portion of the new roll fiberboard 54) is detected by the photoelectric detector 7, the detection information from the photoelectric detector 7 is sent to the controller 40. Additionally, the information from the rotary encoder 6 is also inputted to the controller 40. The controller 40 obtains, on the basis of the information from the rotary encoder 6, an angle of the arm 30*b* at the time that the outer-diameter portion of the roll fiberboard 54 is detected by the photoelectric detector 7 to calculate a horizontal position of the new roll fiberboard 54 and a vertical position thereof (that is, the central position of the new roll fiberboard 54) on the basis of the angle information on the arm 30*b*.

Still additionally, the controller 40 outputs a control signal to the motor 5, placed in the fiberboard splice unit moving device 9, on the basis of the information (roll fiberboard position information) about the horizontal position and vertical position of the new roll fiberboard 54 (namely, the central position of the new roll fiberboard 54) and the information (fiberboard splice unit position information) about the position of the fiberboard splice unit 2 from the rotary encoder 6 so that the fiberboard splice unit 2 is accurately aligned with a predetermined position above the new roll fiberboard 54 and in opposed relation to the roll fiberboard 54.

Accordingly, irrespective of the variation in the diameter of the new roll fiberboard 54, the fiberboard splice unit 2 can always be located at the predetermined position above (almost right above) the new roll fiberboard 54.

Furthermore, referring to FIG. 2, a description will be given hereinbelow of a concrete construction of the fiberboard splice unit 2.

Figure 2:
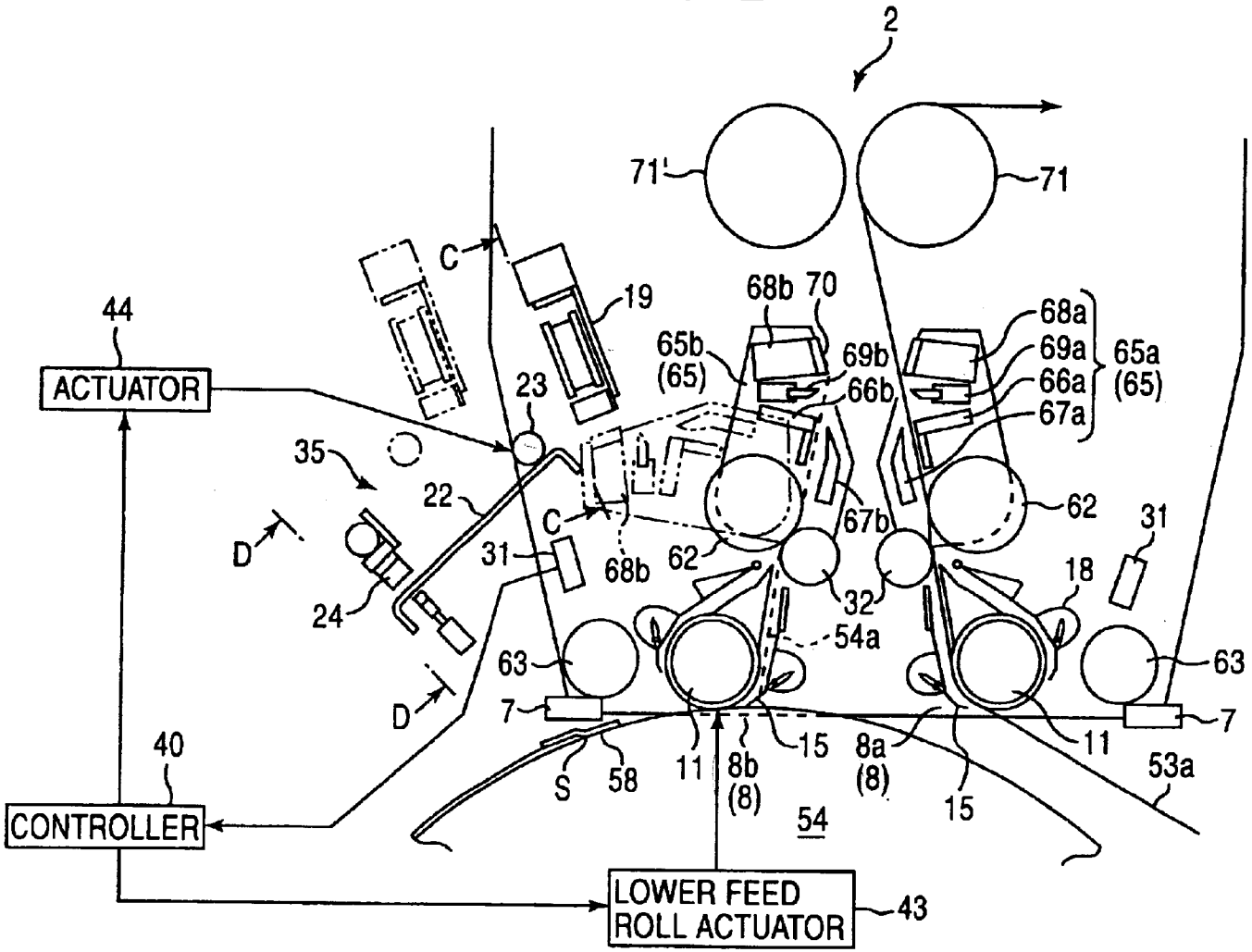
FIG. 2 is a cross-sectional view illustratively showing a fiberboard splice unit of the fiberboard splice apparatus according to the embodiment of the invention.

As FIG. 2 shows, the fiberboard splice unit 2 is made up of a pair of fiberboard splice parts 65 (65*a*, 65*b*) including fixed stop bars 66*a*, 66*b*, a movable stop bars 67*a*, 67*b*, pressing bars 68*a*, 68*b* and knives 69*a*, 69*b*, a pair of fiberboard feed devices 8 (8*a*, 8*b*) respectively placed under the fiberboard splice parts 65*a* and 65*b*, a tape adhering device 19 for adhering a pressure sensitive adhesive double coated tape to an end portion of a new fiberboard (new web) 54*a* fed from the new roll fiberboard 54, and a fiberboard end processing device 35 including a table 22, a drive roller 23 and a fiberboard end holding device 24.

Figure 15:
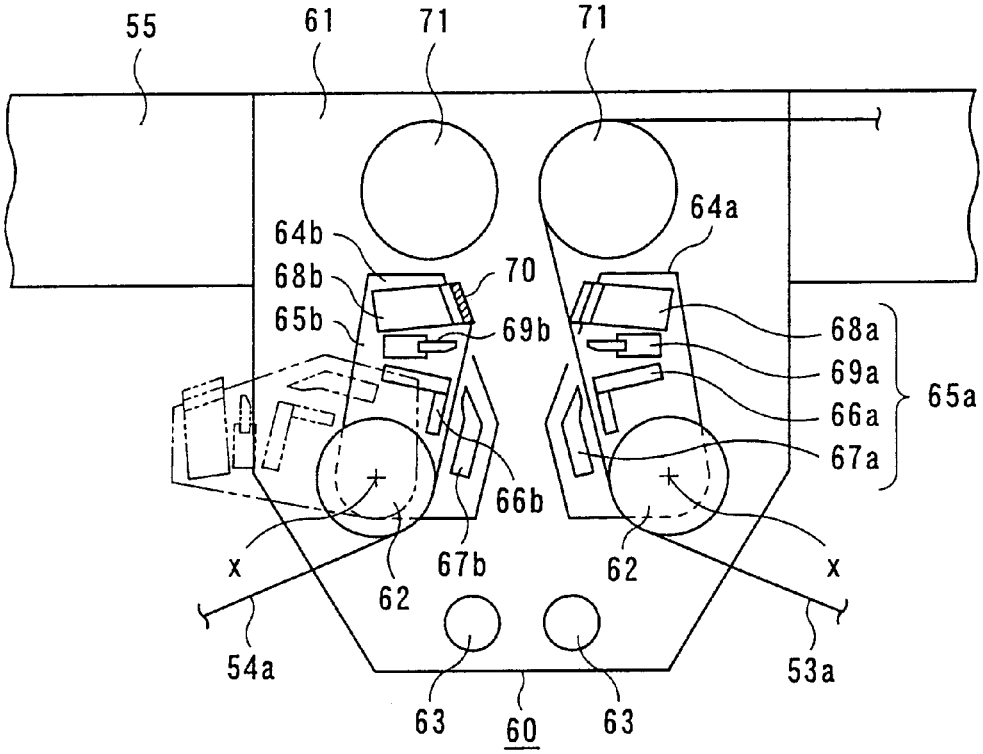
F I G. 1 5 RELATED ART
FIG. 15 is an enlarged view illustratively showing a common fiberboard splice apparatus.

The fiberboard splice parts 65*a* and 65*b* are located in opposed relation to each other for adhering an end portion of the new fiberboard (new web) 54*a* fed from the new roll fiberboard (the other roll fiberboard) 54 to the old fiberboard (old web) 53*a* fed from the old roll fiberboard (the one roll fiberboard) 53 and is being presently supplied, and is constructed like that in the above-mentioned related art (see FIG. 15).

Downwardly of the fiberboard splice unit 65, a pair of upper guide rolls 62, 62 are disposed in association with the respective fiberboard splice parts 65*a*, 65*b* of the splice unit 65, likewise the conventional art described in "Description of Related Art" of the specification in connection with FIG. 15. And a pair of upper feed rolls 32, 32 are disposed in confronting relation to the respective upper guide rolls 62, 62.

Each of the upper feed rolls 32 is movable toward and away from the associated upper guide roll 62 so that the upper feed roll 32 comes into contact with the web 53*a* (or 54*a*), which is introduced into the fiberboard splice unit 65 from the associated fiberboard feed device 8, with a suitable amount of pinch pressure and, otherwise, a suitable gap is provided between the circumferential surface of the upper feed roll 32 and the web 53*a* (or 54*a*) introduced into the fiberboard splice unit 65 from the associated fiberboard feed device 8.

The fiberboard feed device 8 (8*a*, 8*b*) is placed under an upper guide roll 62 and an upper feed roll 32 for feeding a web (fiberboard) from a roll fiberboard unrolled to the fiberboard splice part 65 (65*a*, 65*b*).

For example, at the ordinary operation, the old web 53*a* pulled out from the old roll fiberboard 53 unwound passes through the fiberboard feed device 8*a* to get between the upper guide roll 62 and the upper feed roll 32 and then passes through the fiberboard splice part 65*a* (that is, between the fixed stop bar 66*a* and the movable stop bar 67*a*) to reach an acceleration roll 71. In this case, the old web 53*a* from the old roll fiberboard 53 unwound is driven by a lower feed roll 11, which will be stated later, and the acceleration roll 71.

In a case in which the new web (new fiberboard) 54*a* pulled out from the new roll fiberboard 54 unrolled is spliced to the old web (old fiberboard) 53*a* from the old roll fiberboard 53 unrolled, the fiberboard feed device 8*b* picks up the fiberboard end portion S of the new roll fiberboard 54, and as indicated by a broken line in FIG. 2, the new web 54*a* drawn out from the new roll fiberboard 54 unrolled is passed between the upper guide roll 62 and the upper feed roll 32 to be fed into the fiberboard splice part 65*b*. In this case, as shown in FIG. 2, an appropriate nip pressure is applied onto the old web 53*a* from the old roll fiberboard 53 unrolled by means of the upper guide roll 62 and the upper feed roll 32.

Figure 3:
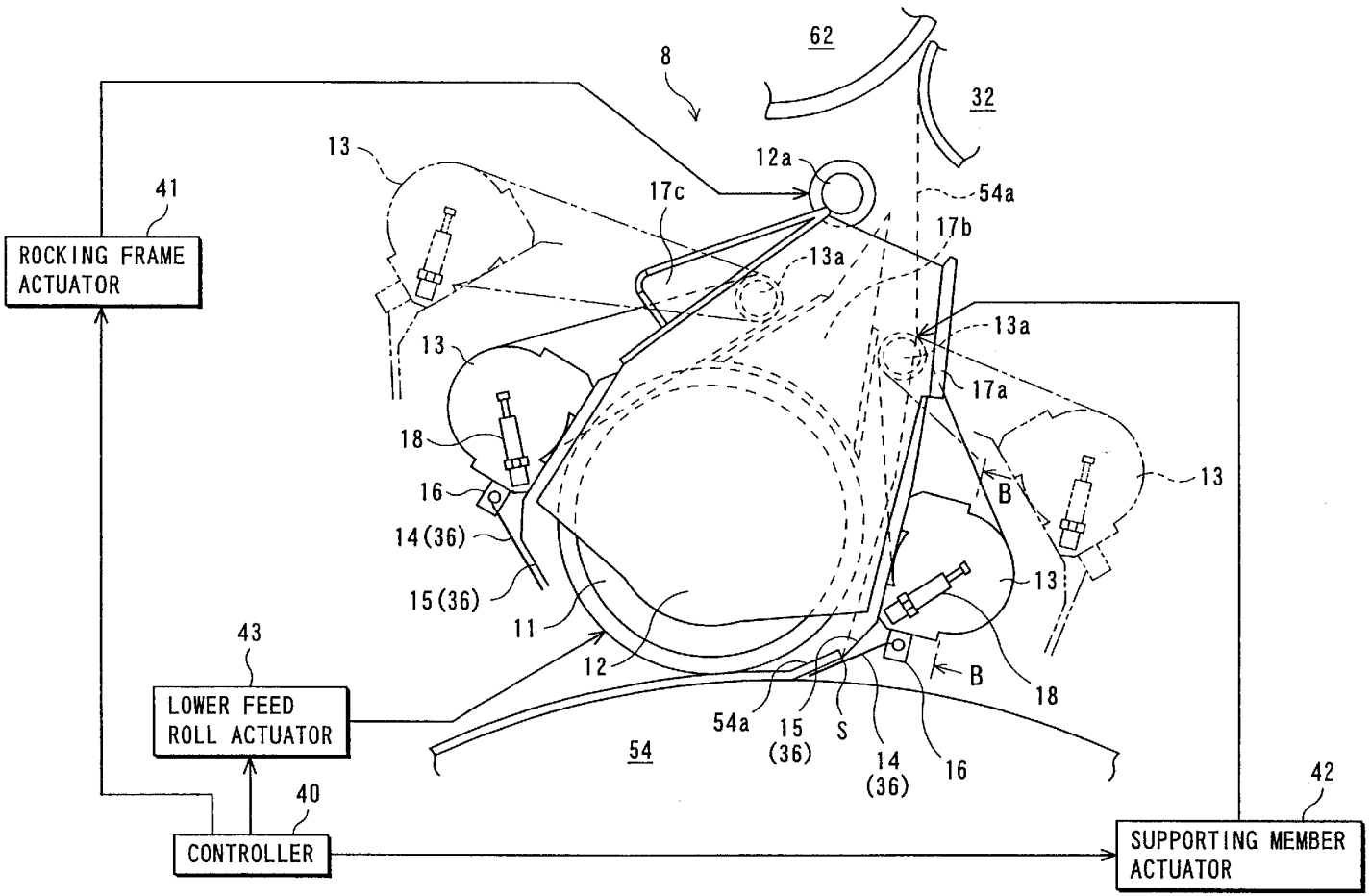
FIG. 3 is an enlarged view illustratively showing a fiberboard feed device included in the fiberboard splice apparatus according to the embodiment of the invention.
Figure 6:
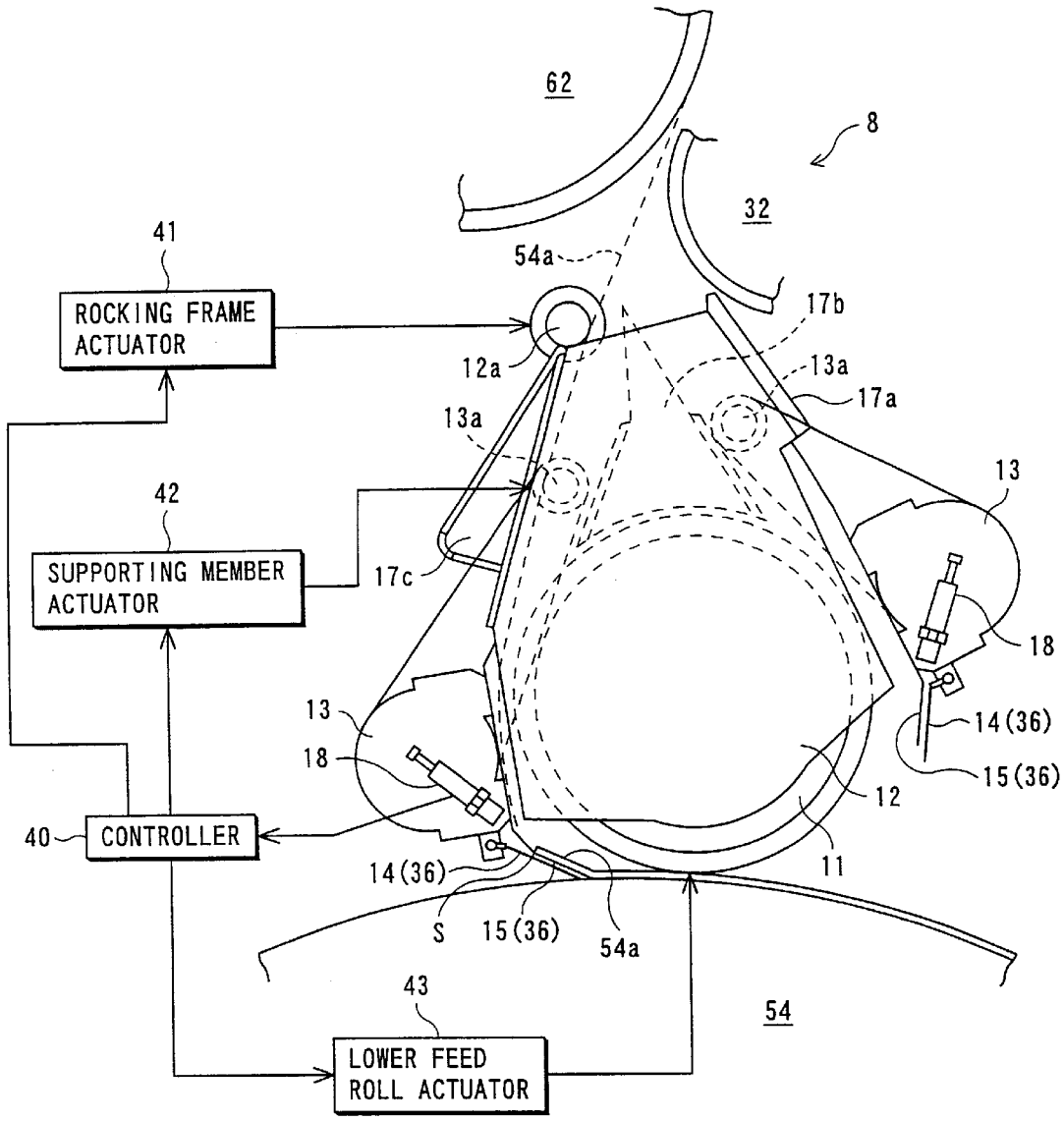
FIG. 6 is an enlarged view illustratively showing the fiberboard feed device included in the fiberboard splice apparatus according to the embodiment of the invention, and is for describing a case in which a roll fiberboard is in the reverse winding condition with respect to that in FIG. 3.

As FIGS. 3 and 6 show, in this embodiment, this fiberboard feed device 8 is located along the axial direction of the new roll fiberboard 54, and is composed of one feed roll (fiberboard feed roll) 11 for rotating the new roll fiberboard 54 while coming into contact with a surface of the new roll fiberboard 54, a pair of pickup members 36 for picking up a tip portion of the new roll fiberboard 54 while coming into sliding contact with a surface of the new roll fiberboard 54, and a plurality of guides 17*a*, 17*b*, 17*c* acting as guide members for guiding the new web 54*a* drawn out by the unrolling of the new roll fiberboard 54 picked up by each of the pickup member 36 to the fiberboard splice part 65.

The lower feed roll 11 extends along a web cross direction (direction perpendicular to the web conveying direction), and is for unrolling the new roll fiberboard 54 to forward the fiberboard toward the fiberboard splice parts 65*a* and 65*b*.

In this case, rocking frames (roll supporting frames) 12 and 12 are respectively supported at the inner sides of both side frames (not shown) of the fiberboard splice unit 2 to be rockable, and both end portions of the lower feed roll 11 are supported between these rocking frames 12 and 12 to be rotatable (rockable).

In this embodiment, the rocking frames 12 and 12 are attached through a pin (pin member, supporting member) 12*a* to both the side frames (not shown) of the fiberboard splice unit 2. Incidentally, the rocking frame 12 and the pin 12*a* are equally referred to as a "rocking mechanism".

In addition, a rocking frame actuator (rocking actuator) 41 such as a motor is attached to this pin 12*a,* and when the pin 12*a* is rotated by the rocking frame actuator 41, the rocking frames 12 are rockable around the axis (rocking supporting point) of the pin 12*a*. At this time, the rocking frame actuator 41 is made to be controlled in accordance with a control signal from the controller 40.

Incidentally, although the rocking frames 12 are supported by the pin 12*a,* the present invention is not limited to this, but it is also appropriate that they are supported by a beam extending between both the side frames (not shown) of the fiberboard splice unit 2.

When the rocking frames 12 are rocked in this way, the fiberboard feed device 8 fitted to the rocking frames 12 and comprising the lower feed roll 11, the pickup member 36, the pickup member supporting member 13, the guides 17*a,* 17*b* and 17*c* and others which are constructed as a compact unit rocks on the axis (rocking supporting point) of the pin 12*a*.

Thus, the rockable rocking frames 12, the rocking frame actuator 41 for rocking (rotating) the rocking frames 12, and the controller 40 for controlling the operation of the rocking frame actuator 41 are made to rock the fiberboard feed device 8 (that is, rock the lower roll 11 and the pickup member 36 unitarily up to a predetermined position) in accordance with the unrolling direction of the other roll fiberboard 54, and therefore, they are referred to as "rocking means". Incidentally, the rocking means can be constructed to include the pin 12*a*.

Although for rocking the rocking frames 12 the pin 12*a* is automatically driven rotationally in accordance with a control signal from the controller 40, for example, it is also appropriate that the rocking frames 12 are equipped with a handle or the like so that the operator manipulates the handle or the like to manually rock the rocking frames 12. In this case, the rocking means (rocking mechanism) comprises the rocking frames 12.

Moreover, in this case, since the pickup member supporting member 13 is equipped with a fiberboard detection sensor 18 as will be mentioned later, this fiberboard detection sensor 18 is also included in the pickup member rocking means.

In this embodiment, as FIG. 2 shows, the fiberboard feed device 8 is constructed to be rockable, and this is for coping with a change of the drawing direction of the roll fiberboard 54.

Figure 10:
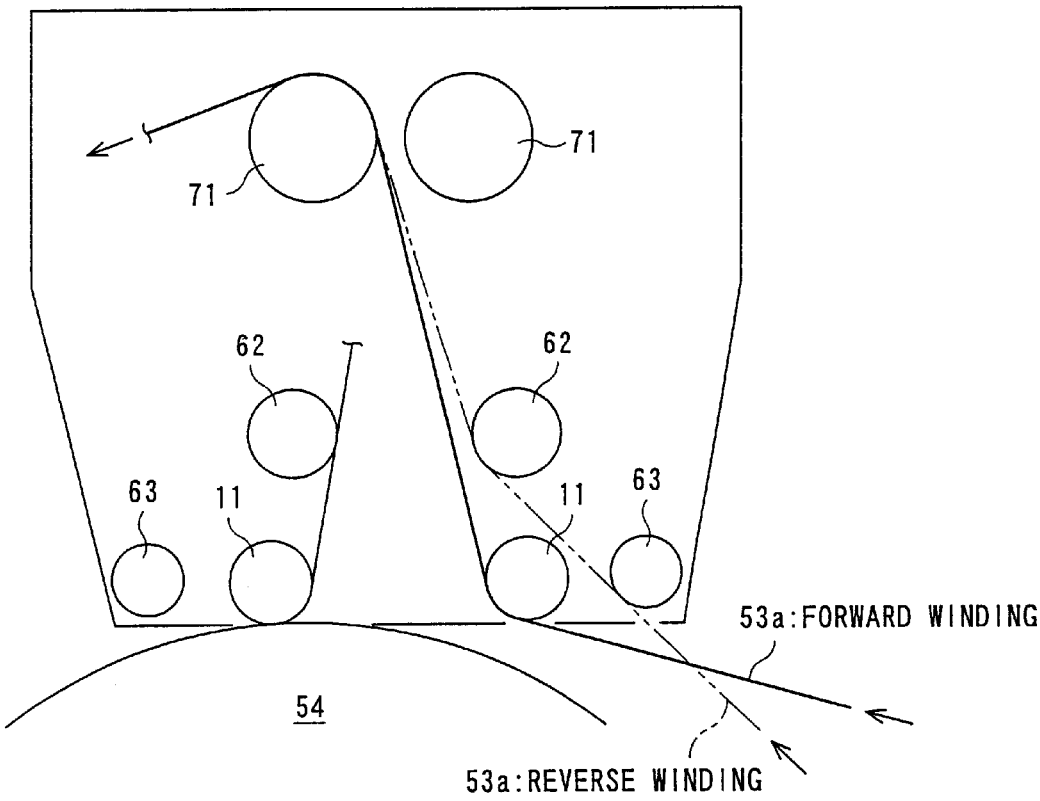
FIG. 10 is an enlarged view illustratively showing the fiberboard splice apparatus according to the embodiment of the invention, and is for explaining a case in which a roll fiberboard is in the reverse winding condition.

That is, taking the roll fiberboard 53 supported by the mill roll stand 52 (the right side in FIG. 14) for instance, there are a case in which the roll fiberboard 53 is rotated clockwise in drawing out a fiberboard (web) (which is referred to as "right-hand supply") and a case in which the roll fiberboard 54 is rotated counterclockwise in drawing out a fiberboard (web) (which is referred to as "left-hand supply"). FIG. 10 illustrates a traveling path of the fiberboard in the case of the left-hand supply.

This is because a fiberboard has a face and a back and the roll fiberboard is available in a state wound such that its face appears on its outer surface (which is referred to as "face winding") and in a state wound such that its back appears on its outer surface (which is called "back winding") and in a case in which the roll fiberboard (supported by the right-hand mill roll stand in FIG. 14) for a linerboard and the roll fiberboard (supported by the left-hand mill roll stand in FIG. 14) for a corrugating medium are adhered to each other to produce a corrugated fiberboard sheet, since the side appearing on the surface preferably forms the fiberboard face, the face-winding roll fiberboard and the back-winding roll fiberboard need to take opposite roll fiberboard drawing directions.

Incidentally, when the roll fiberboard is viewed from the external, a fiberboard winding way taken for unrolling the roll fiberboard from the inside to the outside is sometimes referred to as "forward winding" while a fiberboard winding way taken for unrolling the roll fiberboard from the outside to the inside is sometimes referred to as "reverse winding". For example, in FIG. 14, the "forward winding" is for the purpose of rotating counterclockwise and unrolling the old roll fiberboard 53 held on the right side of the mill roll stand 52 while the "reverse winding" is for rotating clockwise and unrolling it. On the other hand, if the new roll fiberboard 54 supported on the left side of the mill roll stand 52 is rotated clockwise to be unrolled, then it is called "forward winding", while if being rotated counterclockwise to be unrolled, then it is called "reverse winding".

Figure 14:
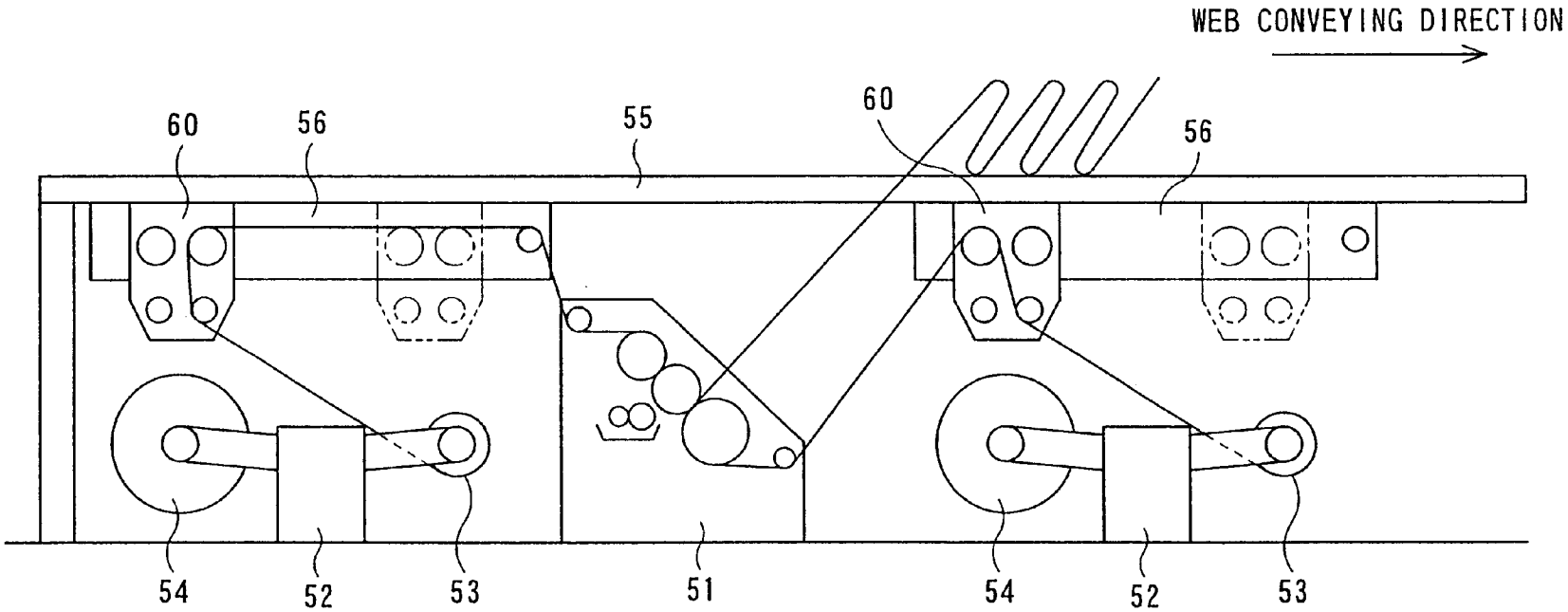
FIG. 14 is an illustrative view for explaining a single facer and a mill roll stand included in a common corrugate machine.

FIG. 14 shows a reverse-winding condition, while FIG. 10 illustrates a forward-winding condition. Moreover, in FIG. 10, reference numeral 63 represents a lower guide roll 63, with this lower guide roll 63 being to be used in the case of the reverse-winding. That is, as indicated by a two-dot chain line in FIG. 10, in place of the lower feed roll 11, the lower guide roll 63 functions as a guide roll in a case in which the old web 53*a* appearing by the unrolling of the old roll fiberboard 53 (reserve winding) supported by a right-hand arm 30*a* of the mill roll stand 10 is reversely drawn out (or the new web 54*a* is reversely drawn out). In this case, the pick up member supporting member 13 is retreated (retracted) up to a position at which it does not come into contact with the old web 53*a*.

In this case, since the roll fiberboard 54 is in the back-winding condition in which the winding is made in a state where the fiberboard back forms its outer surface (see FIG. 14), in the preparation for the fiberboard splice process, as shown in FIG. 3, the pin 12*a* is rocked (rotated) up to a predetermined position so that the lower feed roll 11 is brought into contact with a surface of the roll fiberboard 54 at a first position, and the pin (pin member, supporting member) 13*a* is rocked (rotated) to bring the tip portion of a finger 15 or a cutter 14 constituting one (right side in FIG. 3) pickup member (36) into contact with the surface of the roll fiberboard 54.

Thus, in a case in which the pin 12*a* is rotated up to a predetermined position so that lower feed roll 11, the finger 15 and the cutter 14 are positioned to come into contact with the surface of the roll fiberboard 54, as FIG. 3 shows, a fiberboard supply path leading up to the fiberboard splice part 65*b* is defined between the finger 15 and the lower feed roll 11 and between the guide 17*a* and the guide 17*b,* and as indicated by a broken line in FIG. 3, the new web 54*a* is guided through the fiberboard supply path.

On the other hand, in a case in which the roll fiberboard 54 is in the face-winding condition in which the fiberboard face forms its outer surface, as shown in FIG. 6, the pin 12*a* is rocked (rotated) up to a predetermined position so that the lower feed roll 11 is brought into contact with the surface of the roll fiberboard 54 at a second position different from the aforesaid first position, and the pin 13*a* is rocked (rotated) to bring the tip portion of the finger 15 or the cutter 14 constituting the other (left side in FIG. 6) pickup member 36 into contact with the surface of the roll fiberboard 54.

Thus, in a case in which the pin 12*a* is rotated up to a predetermined position so that lower feed roll 11, the finger 15 and the cutter 14 are positioned to come into contact with the surface of the roll fiberboard 54, as FIG. 6 shows, a fiberboard supply path leading up to the fiberboard splice part 65*b* is defined between the finger 15 and the lower feed roll 11 and between the guide 17*b* and the guide 17*c,* and as indicated by a broken line in FIG. 6, the new web 54*a* is guided through the fiberboard supply path.

In this way, the simple control using the compact fiberboard feed device 8 can handle the roll fiberboard 54 even if the roll fiberboard 54 is in the face-winding condition or in the back-winding condition, which provides a construction suitable for automatic fiberboard feed.

Meanwhile, as FIG. 3 shows, the pickup member 36 is equipped with the finger 15 having a function to pick up a fiberboard end portion S of the new roll fiberboard 54 and a function to guide the new web 54*a* forwarded from the new roll fiberboard 54 and the cutter 14 having a function to pick up the fiberboard end portion S of the new roll fiberboard 54 and a function to cut a tape (color tape) 58 adhered onto an outer surface of the roll fiberboard 54 for the prevention of the release of the tip portion of the roll fiberboard 54 from the fixed condition, and being mounted on the pickup member supporting member 13.

In this embodiment, the pickup members 36, 36 are situated on both the sides of the lower feed roll 11 to interpose the lower feed roll 11 therebetween for coping with the case that the new roll fiberboard 54 takes a "left-hand unrolling direction" and the case it takes a "right-hand unrolling direction". That is, the pair of pickup members 36, 36 are mounted on the pair of pickup member supporting members 13, 13, supported by the rocking frames 12, 12 to be rockable (rotatable), so that they are positioned on both the sides of the lower feed roll 11 to interpose it therebetween.

In addition, the rocking motion of the pickup member supporting members 13 cause the pickup members 36 to approach and separate from the lower feed roll 11. Thus, according to the unrolling direction of the new roll fiberboard 54, any one of the pickup members 36 is brought close to the lower feed roll 11 to take the pickup position, thereby picking up the fiberboard end portion S of the new roll fiberboard 54.

In this connection, after the fiberboard end portion S of the new roll fiberboard 54 is picked up and the new web 54*a* is introduced into the fiberboard splice part 65*b,* the pickup member 36 is shifted to separate from the lower feed roll 11 to take a retreated position. This prevents the pickup member 36 from interfering with the new web 54*a* after the completion of the fiberboard splice. In particular, when the apparatus enters the ordinary operation after the completion of the fiberboard splice, the new web 54*a* is fed to pass between the pickup member 36 and the lower feed roll 11 in the fiberboard feed device 8, and even at this time, it is possible to prevent the pickup member 36 from interfering with the new web 54*a*.

Each of the pair of pickup member supporting members 13, 13 is designed to be rockable (rotatable) independently with respect to the rocking frame 12 (lower feed roll 11).

In this case, the pair of pickup member supporting members 13, 13 are fitted through the pins 13*a,* 13*a* to the rocking frames 12, 12, respectively. The pickup member supporting member 13 and the pin 13*a* are equally referred to as a "pickup member rocking mechanism".

In addition, a supporting member actuator (rocking actuator, pickup member actuator) 42 such as a motor is set to each of these pins 13*a*, 13*a*, and each of the pair of pickup member supporting members 13, 13 is rockable around the axis (rocking supporting point) of the pin 13*a* with each of the pins 13*a*, 13*a* being rotated by means of each of the supporting member actuators 42. At this time, the operation of the supporting member actuator 42 is controlled in accordance with a control signal from the controller 40.

Although the pair of pickup member supporting members 13, 13 are supported by the pins 13*a,* the present invention is not limited to this, but it is also possible that they are supported through the use of a beam stretched between the rocking frames 12, 12.

Thus, the rockable pickup supporting member 13, the supporting member actuator 42 for rocking (rotating) the pickup member supporting member 13 and the controller 40 for controlling the operation of the supporting member actuator 42 function as a unit to rocking the pickup member 36 and, hence, are referred to as a "pickup member rocking means". In this case, this pickup member rocking means can include the pin 13*a*.

Incidentally, in the above description, although the pin 13*a* is automatically driven rotationally in accordance with a control signal from the controller 40 for rocking the pickup member supporting member 13, it is also acceptable that, for example, the pickup member supporting member 13 is equipped with a handle or the like and an operator operates this handle or the like for rocking the pickup member supporting member 13. In this case, the pickup member rocking means (pickup member rocking mechanism) is made up of the pickup member supporting member 13.

Moreover, in this case, although the pickup member supporting member 13 is mounted on the rocking frame 12 to be rockable, the present invention is not limited to this, but it is also possible that the pickup member supporting member 13 is fixedly secured to the rocking frame 12.

In this construction, the finger 15 constituting the pickup member 36 is constructed as a flat member (flat-plate-like member) extending along the cross direction of the new roll fiberboard 54, and is fixedly secured to the pickup member supporting member (finger supporting member) 13.

One end portion of the finger 15 is formed to have a shape and width which can function as a scraper made to pick up the tip portion S of the new web 54*a* from the new roll fiberboard 54. On the other hand, the other end side of the finger 15 extends toward the guide 17*a* (or the guide 17*c*) to function as a guide member.

As mentioned above, since the finger 15 is constructed as a flat member extending along the cross direction of the new roll fiberboard 54, the tip portion S of the new roll fiberboard 54 picked up by the finger 15 and the cutter 14 are guided surely in the cross direction thereof.

The cutter 14 constituting the pickup member 36 is designed to be capable of cutting the tape 58 at its side portion, and is attached to the pickup member supporting member (cutter supporting member) 13 along the axial direction (cross direction) of the lower feed roll 11 (that is, along the cross direction of the roll fiberboard 54) to be movable. This cutter 14 is placed outside the finger 15, i.e., on a side close to the surface of the new roll fiberboard 54.

In this embodiment, a plurality of tapes 58 are adhered onto the tip portion S of the new roll fiberboard 54 at an appropriate interval, and hence, a plurality of (in this case, two) cutters 14 are located at an appropriate interval in consideration of the adhesion positions of the tapes 58.

Figure 4:
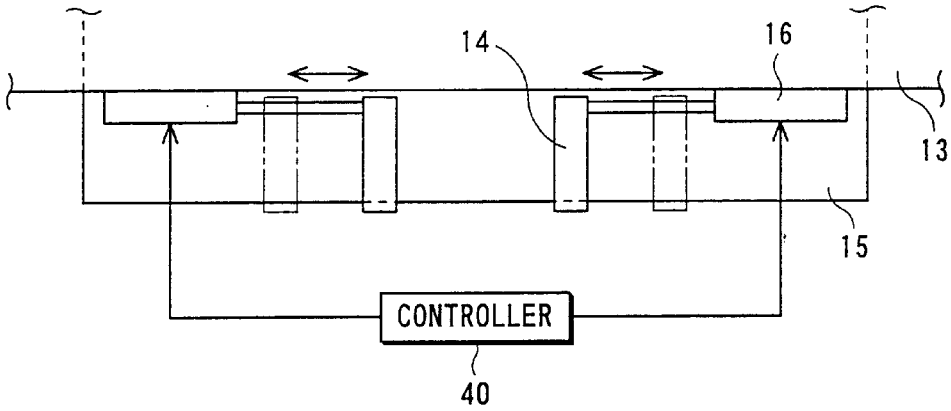
FIG. 4 is an illustrative view useful for describing a cutter included in the fiberboard splice apparatus according to the embodiment of the invention.

In addition, a cutter actuator (pickup member actuator) 16 such as an air cylinder is operatively associated with the cutters 14 to be capable of reciprocating along a surface of the finger 15 as indicated by arrows in FIG. 4. In FIG. 4, the cutters 14 which are in a shifted condition are shown by two-dot chain lines.

When the cutters 14 are shifted in parallel with the surface of the finger 15 in this way, the cutters 14 move along the surface of the new roll fiberboard 54 in the axial directions of the new roll fiberboard 54. Accordingly, the tip portions of the cutters 14 enter under the fiberboard end portion S lying between the plurality of tapes 58 adhered to the fiberboard end portion S, and in this state, when the cutters 14 are shifted in the axial directions of the new roll fiberboard 54 (namely, in the web cross directions) by means of the cutter actuators 16, the tapes 58 are cut by the sharp-edged side surfaces of the cutters 14.

In this connection, as FIG. 3 shows, the pickup member supporting member 13 is equipped with a sensor (fiberboard detection sensor) 18 such as a reflection type photoelectric detector for detecting the tip portion of the new web 54*a* picked up by the finger 15, with the detection information from this sensor 18 being forwarded to the controller 40.

Moreover, as FIG. 3 shows, a lower feed roll actuator (fiberboard feed roll actuator) 43 such as a motor (driving motor) is operatively associated with the lower feed roll 11 so that the lower feed roll 11 is rotationally driven by an operation of the lower feed roll actuator 43.

Figure 5:
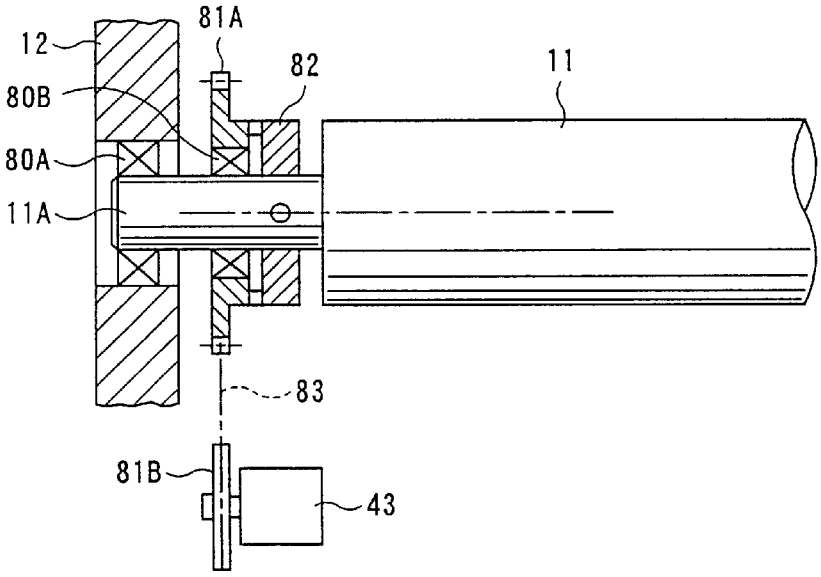
FIG. 5 is an illustrative view useful for describing a drive mechanism for a lower feed roll included in the fiberboard splice apparatus according to the embodiment of the present invention.

As shown in FIG. 5, with respect to the lower feed roll 11, there is placed a clutch (driving force connection/disconnection means) 82 capable of making connection/disconnection of a driving force (rotational driving force) from the fiberboard feed roll actuator 43.

That is, a chain pulley (chain sprocket wheel) 81A is fitted through a bearing 80A over a shift part 11A of the lower feed roll 11 and the clutch 82 is connected to the chain pulley 81A. Moreover, a chain pulley (chain sprocket wheel) 81B is connected to the driving motor 43 acting as the lower feed roll actuator.

In addition, a chain 83 is wound around the chain pulleys 81A and 81B so that a driving force from the driving motor 43 is transmitted through the chain pulley 81B, the chain 83, the chain pulley 81A and the clutch 82 to the lower feed roll 11.

Accordingly, when the driving force from the driving motor 43 is transmitted to the lower feed roll 11 in a state where the clutch 82 is set into a connection condition ("on" side), the lower feed roll 11 is rotationally driven, and when the clutch 82 is switched into the disconnection condition ("off" side) to cut off the transmission of the driving force from the driving motor 43 to the lower feed roll 11, the rotational driving of the lower feed roll 11 comes to a stop.

In this case, for the ordinary operation, the clutch 82 is placed at the "off" side to cause the lower feed roll 11 to rotate passively, so the lower feed roll 11 acts merely as a guide roll. On the other hand, for the fiberboard feed (at the ready time), the clutch 82 is switched into the "on" side to rotationally drive the lower feed roll 11, so the lower feed roll 11 exhibits the intended function as a fiberboard feed roll.

The shaft part 11A of the lower feed roll 11 is supported on the rocking frame 12 to be rotatable through the bearing 80A.

Moreover, as FIG. 3 shows, the operation of the lower feed roll actuator 43 is controlled in accordance with a control signal from the controller 40. In this case, when the sensor 18 detects the tip portion of the new web 54*a*, the controller 40 outputs a signal to the lower feed roll actuator (fiberboard feed roll actuator) and outputs a signal to the cutter actuator 16.

Accordingly, in a state where the lower feed roll 11 is in a rotation stopped condition, the cutter 14 is shifted in an axial direction of the new roll fiberboard 54 to cut the tape 58 without any trouble. The embodiment of this construction can achieve the automatization of the fiberboard splice apparatus.

Incidentally, although the lower feed roll 11 is made to be rotated in this construction, it is also appropriate to further rotate the upper feed roll 32. The rotation of both the rolls 11 and 32 enables the new fiberboard fed from the roll fiberboard 54 to be surely led to the fiberboard splice parts 65*a* and 65*b*.

Furthermore, in the fiberboard splice unit 2, as FIG. 2 shows, a color sensor (tape detection sensor) 31 for detecting the color of the color tape 58 is placed on the upstream side of the fiberboard feed device 8 (on the upstream side in the rotating direction of the roll fiberboard 54), and the detection information from this color sensor 31 is sent to the controller 40.

Furthermore, when detecting the presence of the tape 58 on the basis of the detection information from the color sensor 31, the controller 40 places the lower feed roll actuator 43 into operation to implement control so that the rotational speed of the lower feed roll 11 rotating the roll fiberboard 54 while coming into contact with the surface of the roll fiberboard 54 becomes lower than a predetermined rotational speed forming a reference. Thus, the finger 15 and the cutter 14 can securely pick up an end portion of the new roll fiberboard 54. This provides a construction suitable for the automatization of the fiberboard splice apparatus.

In this case, it is preferable that the tape 58 (if a plurality of tapes are adhered thereto, at least one of them) is a tape with a color which is easily detectable by the color sensor 31. Additionally, preferably, the adhering position of the tape 58 is determined, for example, to be separated by a generally constant distance from the central portion of the roll fiberboard 54 in its cross direction. Still additionally, it is also appropriate that the adhering position of the tape 58 is not determined in advance but the color sensor 31 is designed to be movable in the cross directions of the roll fiberboard 54 to detect the presence or absence of the tape 58. Still additionally, in this case, although the color sensor 31 is used for detecting the presence or absence of the tape 58, the present invention is not limited to this, but it is also acceptable to employ a different tape detection sensor whereby the presence of the tape 58 is detectable.

As FIG. 3 shows, each of the guides 17*a*, 17*b* and 17*c* is fixedly secured to the rocking frames 12, 12. Thus, simply by rocking the rocking frames 12, 12 to shift the lower feed roll 11 to a predetermined position, the guides 17*a*, 17*b* and 17*c* are shifted up to predetermined positions in this connection, thereby defining the fiberboard supply path toward the upper guide roll 62 and the upper feed roll 32.

In this case, the guide 17*a* is constructed as a flat member extending along the web cross direction, and when the one (right side in FIG. 3) pickup member 36 lies at a position where the pickup is possible, it is stretched between the two rocking frames 12 and 12 to be positioned on the extension of the finger 15 functioning as a guide member.

In addition, the guide 17*b* is constructed as a prismatic member extending along the web cross direction, and is composed of a curved surface positioned in opposed relation to the lower feed roll 11, a flat surface positioned in opposed relation to the guide 17*a* and a bent flat surface positioned in opposed relation to the guide 17*c,* and it is stretched between the two rocking frames 12 and 12.

Still additionally, the guide 17*c* is constructed as a prismatic member extending along the web cross direction, and when the other (left side in FIG. 3) pickup member 36 exists at a position where the pickup is possible, it is stretched between the rocking frames 12 and 12 to be positioned on the extension of the finger 15 functioning as a guide member.

Incidentally, in this construction, not only the guides 17*a*, 17*b* and 17*c* act as guide members, but the lower feed roll 11, the upper feed roll 32 and the finger 15, which will be mentioned later, located along the fiberboard supply path for the new web 54*a* fed from the new roll fiberboard 54, also function as guide members.

Figure 7:
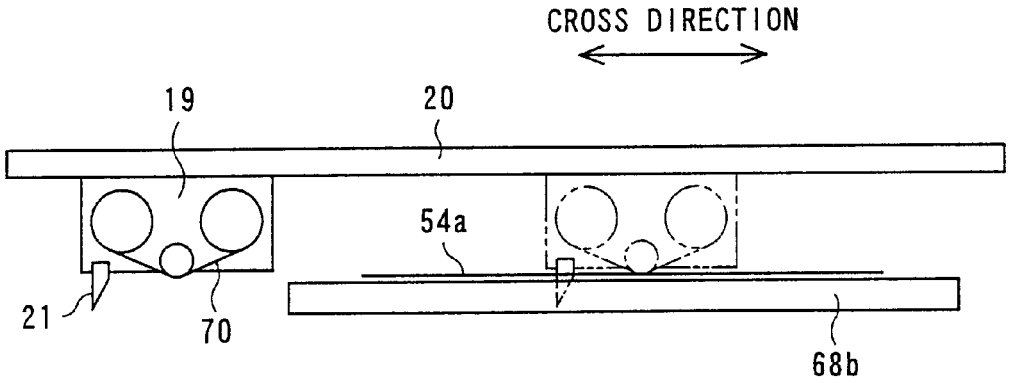
FIG. 7 is an illustrative view useful for describing a tape adhering device included in the fiberboard splice apparatus according to the embodiment of the invention, and is taken along the line C—C of FIG. 2.

As indicated by two-dot chain line in FIG. 2, the tape adhering device 19 is positioned to face a pressing bar 68*b* of the fiberboard splice part 65*b* in a state where the fiberboard splice part 65*b* is pushed down for the preparation for the fiberboard splice process. This tape adhering device 19 can accept a well-known construction, for example, the construction disclosed in Japanese Patent Laid-Open No. (SHO) 61-111264. That is, the tape adhering device 19 is designed to automatically cut an end portion of the roll fiberboard 54 concurrently with adhering a pressure sensitive adhesive double coated tape 70. For this function, a fiberboard cutting knife 21 is provided additionally as shown in FIG. 7. This can achieve the automatization of the fiberboard splice apparatus. Incidentally, in the preparatory stage for the fiberboard splice process, the tape adhering device 19 is retreated to a position indicated by a two-dot chain line in FIG. 2 to prevent the fiberboard splice part 65 from constituting an obstacle.

As FIG. 7 shows, this tape adhering device 19 is designed to adhere the pressure sensitive adhesive double coated tape 70 to the cut end portion of the new web 54*a* while traveling on a rail 20 extending along the web cross direction (machine cross direction).

In addition, the tape adhering device 19 is equipped with a knife 21 to cut the roll fiberboard 54 along the web cross direction concurrently with adhering the pressure sensitive adhesive double coated tape 70.

The fiberboard end processing device 79 is, as shown in FIG. 2, made up of a table 22 for supporting and guiding the new web 54*a* to be led through the fiberboard splice part 65*b* to a fiberboard end holding device (fiberboard holding device) 24, a drive roller 23 disposed on the table 22 to be touchable and separable, and the fiberboard end holding device 24 disposed in a state where the table 22 is interposed, and is for cutting the new web 54*a* by a predetermined length (for example, one turn of the roll) from the tip portion thereof and removing the cut portion. This can automate the fiberboard splice apparatus. Incidentally, a drive roller actuator 44 such as a motor is driven rotationally in accordance with a control signal from the controller 40. This rotationally drives the drive roller 23.

Of these parts, in the preparatory stage for the fiberboard splice process, the table 22 is placed to protrude from the interior of the fiberboard splice unit 2 to the exterior thereof so that it is linked with a surface position (pressing surface position) of the pressing bar 68*b* of the fiberboard splice part 65*b* pushed down as indicated by the two-dot chain line in FIG. 2.

The drive roller 23 is for leading the roll fiberboard 54, guided through the fiberboard splice part 65*b*, to the fiberboard end holding device 24. This drive roller 23 is made to be touchable on and separable from a surface of the table 22, and is retreated up to a position indicated by a two-dot chain line in FIG. 2 in connection with the tape adhering device 19 in the preparatory stage for the fiberboard splice process to prevent the fiberboard splice part 65*b* from constituting an obstacle in the preparatory stage.

Figure 8:
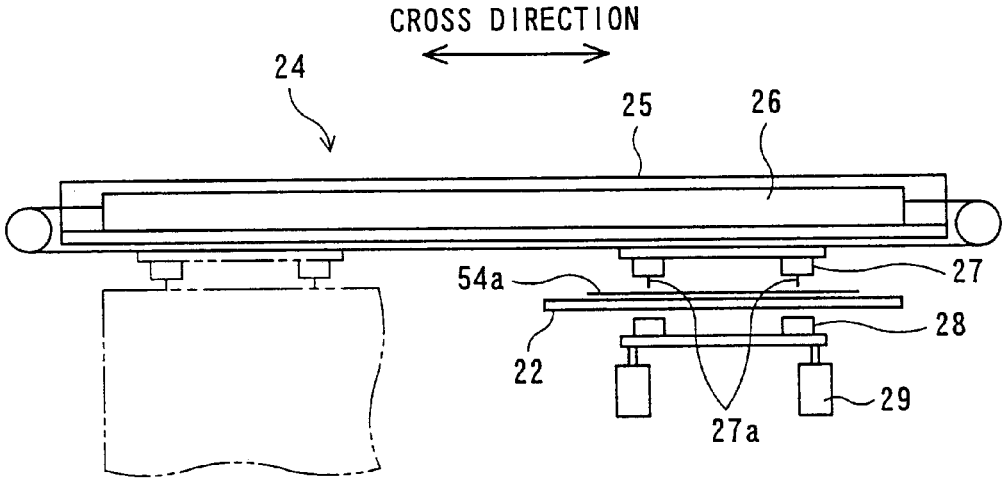
FIG. 8 is an illustrative view useful for describing a fiberboard end processing device included in the fiberboard splice apparatus according to the embodiment of the invention, and is taken along the line D—D of FIG. 2.

As FIG. 8 shows, the fiberboard end holding device 24 is composed of a needle supporter (locking member supporting member) 27 having a plurality of needles (locking members) 27*a* each having a hooking section at its tip portion, and a bearing plate 28 placed on the opposite side to the needles 27*a* in a state the table 22 is interposed therebetween.

The needle supporter 27 is driven by a cable cylinder (locking member supporter reciprocating device) 26 to be capable of reciprocating on a rail (guide member) 25 extending in the web cross directions (machine cross directions). Therefore, the fiberboard cut off on the table 22 can be shifted sideways in a state hooked by the tip portions of the plurality of needles 27*a*.

The bearing plate 28 is driven by an air cylinder (bearing plate actuator) 29 to be movable toward the needles 27*a*. On the movement of the bearing plate 28 in this way, the tip portions of the needles 27*a* stick in the tip portion of the new web 54*a*.

Figure 9A:
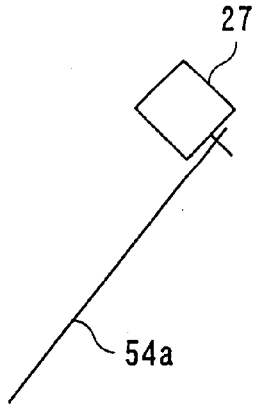
FIG. 9A is an illustrative view useful for describing fiberboard end processing by the fiberboard end processing device included in the fiberboard splice apparatus according to the embodiment of the invention, and shows a case in which the length of a fiberboard to be cut away is relatively short.
Figure 9B:
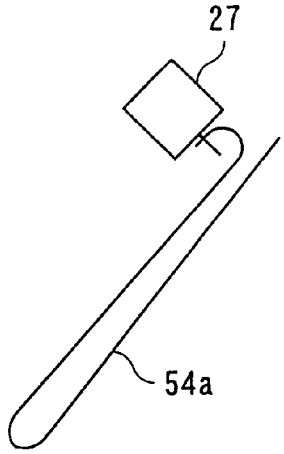
FIG. 9B is an illustrative view useful for describing fiberboard end processing by the fiberboard end processing device included in the fiberboard splice apparatus according to the embodiment of the invention, and shows a case in which the length of a fiberboard to be cut away is somewhat long.
Figure 9C:
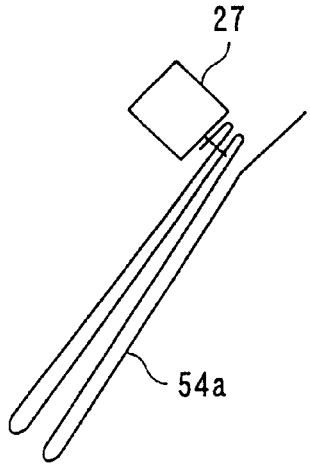
FIG. 9C is an illustrative view useful for describing fiberboard end processing by the fiberboard end processing device included in the fiberboard splice apparatus according to the embodiment of the invention, and shows a case in which the length of a fiberboard to be cut away is relatively long.

Referring to FIGS. 9A to 9C, a description will be given hereinbelow of various methods of cutting the end portion of the new web 54*a* to carry away some length to the outside of the machine.

First, in a case in which the length of the fiberboard to be removed is relatively short, as shown in FIG. 9A, the drive roller 23 feeds the new web 54*a* by a length to be cut and removed with respect to the position (tape adhering position) of the pressing bar 68*b* (68). Following this, the bearing plate 28 is moved by the air cylinder 29 in a direction of approaching the needle 27*a* so that the needle 27*a* sticks in the fiberboard end portion S of the new web 54*a,* and is then returned to the original position. In this state, a pressure sensitive adhesive double coated tape 70 is adhered to a position separated by a predetermined distance (corresponding to the length to be removed) from the tip portion of the new web 54*a* and, at the same time, the new web 54*a* is cut there. Thereafter, as shown in FIG. 8, the fiberboard end holding device 24 is shifted sideways in the state where the fiberboard end S is hooked by the needle 27*a,* and the fiberboard end S cut off is carried away to the exterior of the machine for the disposal. In this case, since the needle 27*a* has a hook portion, the fiberboard end S cut off from the new web 54*a* does not come out of the needle 27*a*.

Furthermore, in a case in which the length to be removed is somewhat long, as shown in FIG. 9B, the tip portion of the new web 54*a* is first held in a state where the needle 27*a* sticks there into. Subsequently, the new web 54*a* is fed by the drive roller 23 to form the end portion of the new web 54*a* into a loop configuration as shown in FIG. 9B. Following this, when this loop portion reaches a predetermined length, the drive roller 23 is stopped to cease the feeding of the new web 54*a*. Additionally, the needle 27*a* is driven to again stick into the new web 54*a*. In this state, the new web 54*a* is cut while the pressure sensitive adhesive double coated tape 70 is adhered to a surface of the new web 54*a* over the pressing bar 68*b* by means of the tape adhering device 19. Then, as shown in FIG. 8, in the state where the fiberboard end S is hooked by the needle 27*a,* the fiberboard end holding device 24 is moved sideways to carry the cut-off fiberboard end S to the exterior of the machine for disposing of it.

Still furthermore, in a case in which the length to be removed is relatively long, as shown in FIG. 9C, the fiberboard of the relatively long length is cut and removed after the repetition of the sticking operation by the needle 27*a* and the new web 54*a* feeding operation by the drive roller 23, and in this case, the fiberboard of the length to be removed is folded into an appropriate easy-to-handle length. Thereafter, in like manner, the new web 54*a* is cut while the pressure sensitive adhesive double coated tape 70 is adhered to a surface of the new web 54*a* over the pressing bar 68*b* (68) by means of the tape adhering device 19. Additionally, as shown in FIG. 8, the fiberboard end holding device 24 is moved sideways in a state where the fiberboard end S is hooked by the needle 27*a* so that the fiberboard end S cut off is conveyed to the exterior of the machine for the disposal.

Since the fiberboard splice apparatus and corrugate machine including this apparatus according to this embodiment are constructed as described above, the fiberboard splice method for use in this apparatus is as follows.

(1) Preparatory Process for Fiberboard Splice Process from Chucking of New Roll Fiberboard 54 to Positioning of Fiberboard Splice Unit 2

Figure 16A:
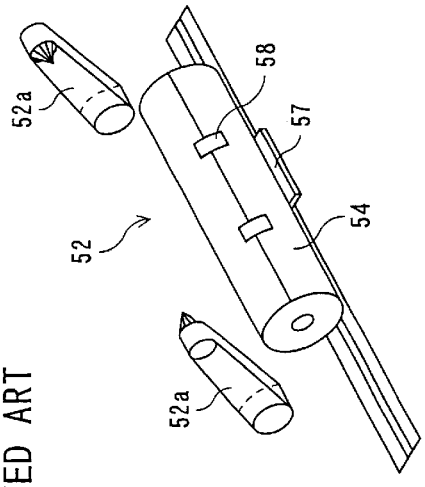
FIG. 16A RELATED ART
FIG. 16A is an illustrative view for explaining preparation for a fiberboard splice process in the case of employment of a common fiberboard splice apparatus, and shows a state where a new roll fiberboard is carried therein.

First, as in the case of the conventional art, the new roll fiberboard 54 is conveyed through the fiberboard supply carriage 57 to the central section of the mill roll stand 10 (see FIG. 16A).

Figure 16B:
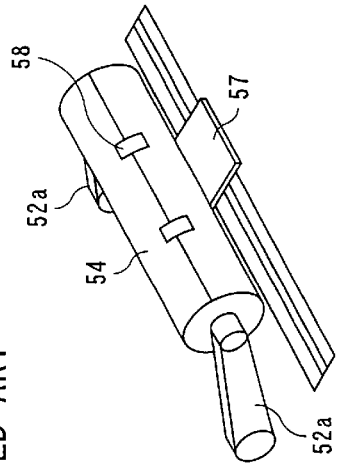
FIG. 16B RELATED ART
FIG. 16B is an illustrative view for explaining the preparation for the fiberboard splice process in the case of employment of the common fiberboard splice apparatus, and shows a state where the new roll fiberboard is lifted.
Figure 16C:
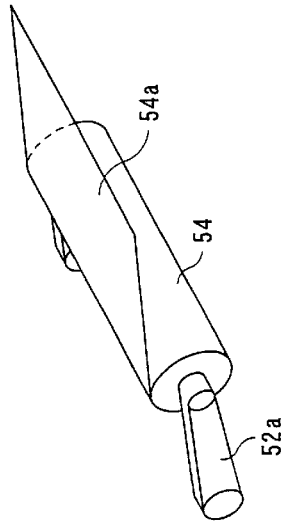
FIG. 16C RELATED ART
FIG. 16C is an illustrative view for explaining the preparation for the fiberboard splice process in the case of employment of the common fiberboard splice apparatus, and shows a state where the tip portion of the new roll fiberboard is pulled out.
Figure 16D:
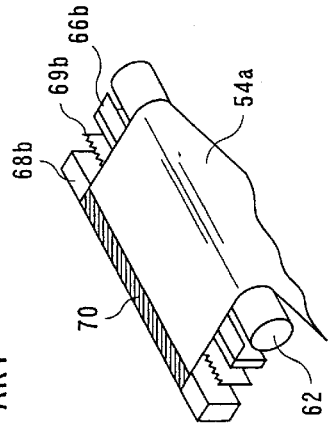
FIG. 16D RELATED ART
FIG. 16D is an illustrative view for explaining the preparation for the fiberboard splice process in the case of employment of the common fiberboard splice apparatus, and shows a state where the new roll fiberboard is led to a fiberboard splice part and a pressure sensitive adhesive double coated tape is adhered to its tip portion.

Subsequently, the new roll fiberboard 54 is chucked by the arms 52*a* of the mill roll stands 52 (see FIG. 16B), and as shown in FIG. 1, is lifted until an outer-diameter portion of the roll fiberboard 54 (an upper surface portion of the roll fiberboard 54) is detected by the photoelectric detector 7.

In this case, the angle of the arm 30*b* is obtained on the basis of the information from the rotary encoder 6 so that the horizontal position and vertical position of the new roll fiberboard 54 (namely, the central position of the new roll fiberboard 54) are calculated as a function of the obtained angle of the arm 30*b*, thereby implementing control to precisely align the fiberboard splice unit 2 with a predetermined position above the new roll fiberboard 54 at all times on the basis of this data and the data (information) on the position of the fiberboard splice unit 2 from the rotary encoder 6. Accordingly, even if the diameter of the new roll fiberboard 54 varies, it is possible to bring the fiberboard splice unit 2 to the predetermined position above (almost just above) the new roll fiberboard 54 at all times.

In addition, since the position of the new roll fiberboard 54 in its height direction is also calculable, it is also possible to calculate the radius of the new roll fiberboard 54 on the basis of the relationship with the fitting position (height) of the photoelectric detector 7, with this value being used in a different process.

(2) Process for Detecting Fiberboard End Position and Cutting Unwinding Prevention Tape First, the upper surface of the new roll fiberboard 54 is detected by the photoelectric detector 7 for positioning the fiberboard splice unit 2 as mentioned above, and the lower feed roll 11 mounted on the rocking frames 12 and 12 is pressed against the surface of the new roll fiberboard 54 as shown in FIG. 3.

In this case, the rocking frames 12 and 12, by which the lower feed roll 11 is held, are rocked in a predetermined direction according to an unrolling direction of the new roll fiberboard 54 by means of the rocking frame actuator 41 to be rotated up to predetermined positions.

The direction in which the rocking frame 12 is rocked depends upon the wound direction of the new roll fiberboard 54 as mentioned above. That is, in a case in which the new roll fiberboard 54 takes the "right-hand supply" condition, the rocking frame 12 is rotated (rocked) clockwise around the rocking supporting point 12*a* to be shifted to a position (first position) as shown in FIG. 3. On the other hand, if the new roll fiberboard 54 takes the "left-hand supply" condition, the rocking frame 12 is rotated (rocked) counter-clockwise around the rocking supporting point 12*a* to be shifted to a position (second position) as shown in FIG. 6.

Simultaneously with this, or following this, the pickup member supporting member 13 is rocked (rotated) to be set at a predetermined position by the supporting member actuator 42 so that the tip portions of the finger 15 and the cutter 14 come into contact with the surface of the new roll fiberboard 54 and the finger 15 and the cutter 14 pick up the fiberboard end portion S of the new roll fiberboard 54.

The lower feed roll 11 is rotated in this state, and the color of the tape (unwinding prevention tape) 58 attached onto the fiberboard end portion S of the new web 54*a* fed from the new roll fiberboard 54 is detected by the color sensor 31, whereby the rotational speed of the lower feed roll 11 is controlled to a low value.

Following this, behind the lower feed roll 11, the cutter 14 waits for the fiberboard end portion S of the new web 54*a* in a state brought into contact with the surface of the new roll fiberboard 54, and when the fiberboard end portion S of the new web 54*a* advances, the tip portion of the cutter 14 is positioned under the fiberboard end portion S to pick up the fiberboard end portion S. Thereafter, when the sensor 18 detects the fiberboard end portion (web tip portion) S of the new web 54*a* picked up by the cutter 14, the lower feed roll 11 is controlled so that its rotation comes to an end.

Subsequently, in a state where the tip portion of the cutter 14 gets under the fiberboard end portion S and between a plurality of tapes 58 attached to the fiberboard end portion S, the cutter 14 is shifted in the axial direction (that is, web cross direction, machine width direction) of the new roll fiberboard 54 by the cutter actuator 16 so that the sharp side surface of the cutter 14 cuts the tapes 58.

The above description relates to the processing to be taken in the case of the "right-hand supply" as shown in FIG. 3. Secondly, a description will be given hereinbelow of the processing in a case of the "left-hand supply".

In the "left-hand supply" case, as shown in FIG. 6, the rocking frames 12 and 12 on which the lower feed roll 11 is mounted are rocked (rotated) in the opposite direction so that the lower feed roll 11 reaches a second position where it is pressed against a surface of the new roll fiberboard 54, and the other side pickup member 36 is rocked (rotated) so that the other side finger 15 and cutter 14 are brought close to the lower feed roll 11 to be pressed against the surface of the new roll fiberboard 54. In this state, the new roll fiberboard 54 made by winding fiberboard into a roll configuration is rotated in a direction opposite to that in the "right-hand supply". The following processing up to the cutting of the tapes 58 is the same as that in the "right-hand supply" case. In this case, the new web 54*a* passes between the guide 17*b* and the guide 17*c* and goes to the upper guide roll 62 and the upper feed roll 32. In this way, even in the case of the "left-hand supply", the processing for the preparation can be conducted as in the case of the above-mentioned "right-hand supply" case.

(3) Process of Handling Fiberboard End Portion

When the cutting of the tape 58 has been conducted as mentioned above, the lower feed roll 11 again rotates the new roll fiberboard 54, made by winding fiberboard into a rolled configuration, for feeding the new web 54*a*. In FIG. 3, the feeding state of this new web 54*a* is indicated by a broken line.

The new web 54*a* fed in this way is guided by the finger 15 and the guides 17*a* and 17*b* to go between the upper guide roll 62 and the upper feed roll 32 and further enter the fiberboard splice part 65*b,* located above, through the upper feed roll 32.

In the fiberboard splice part 65*b,* as indicated by broken lines in FIGS. 2 and 3, the fiberboard end portion (web tip portion) S of the new web 54*a* passes between the fixed stop bar 66*b* and the movable stop bar 67*b* and further runs by a required quantity (predetermined quantity) to advance ahead of the pressing bar 68*b,* where it is held by being caught by the fixed stop bar 66*b* and the movable stop bar 67*b*.

In this case, at the time that the fiberboard end portion S of the new web 54*a* arrives at the guides 17*a* and 17*b,* the pickup member 36 is rocked (rotated) by the pickup member actuator to be retreated up to a position indicated by a two-dot chain line in FIG. 3. This retreated position can be a position at which, at the unrolling in the case of the "reverse winding", the old web 53*a* does not interfere with the finger 15 or the cutter 14, as shown in FIG. 1.

Following this, the fiberboard splice part 65*b* is rotated up to the preparation position (a state indicated by a two-dot chain line in FIG. 2), and after the tape adhering device 19 and the drive roller 23 are returned to a position indicated by a solid line in FIG. 2, the fiberboard end portion S of the new web 54*a* is released from the state held by the stop bars 66*b* and 67*b,* and the lower feed roll 11 and the upper feed roll 32 are again driven so that the new web 54*a* travels a proper length (portion to be removed) to get between the drive roller 23 and the table 22.

Moreover, in a state where the fiberboard end portion S is held by the fiberboard end holding device 24, a pressure sensitive adhesive double coated tape 70 is again adhered thereto by the tape adhering device 19 and the fiberboard end portion S is cut at the same time. The cut new web 54*a* portion of the proper length is removed. Following this, the fiberboard splice part 65*b* is returned to the fiberboard splice preparatory position (stand-by position, a position indicated by a solid line in FIG. 2), and the preparatory work for the fiberboard splice process reaches completion.

Accordingly, with the fiberboard splice apparatus, the corrugate machine including this apparatus and the fiberboard feed method according to this embodiment, since each of the components of the fiberboard splice apparatus is made to be suitable for automation, and particularly, since the manual operation can be eliminated in the preparation for the fiberboard splice process, it is possible to enhance the degree of automatization of the machine. In particular, the switching according to the unrolling direction of the roll fiberboard (that is, the switching according to the unrolling direction depending on the "left-hand supply" or "right-hand supply") is achievable simply by rocking (position changing) the lower feed rolls 11 or the pickup members 36, which can shorten the time required for the preparation therefor to enhance the machine availability factor.

Moreover, since the switching according to the unrolling direction of the roll fiberboard (that is, the switching according to the unrolling direction depending on the "left-hand supply" or "right-hand supply") is achievable simply by rocking (position changing) the lower feed rolls 11 or the pickup members 36, it is possible to realize the automatization of the fiberboard splice apparatus with a simple construction and at a low cost.

In the above description of this embodiment, as FIG. 1 shows, although the new roll fiberboard 54*a* is set on the left-hand arm 30*b* of the mill roll stand 10, even in a case in which the new roll fiberboard is set on the right-hand arm 30*a* of the mill roll stand 10, the preparatory processing on the tip portion of the new web 54*a* can basically be conducted in like manner. However, in this case, there is a need to shift the fiberboard splice unit 2 up to a predetermined position above the new roll fiberboard 54*a* set on the right-hand arm 30*a* of the mill roll stand 10 for conducting the preparatory processing on the tip portion of the new web 54*a* through the use of generally symmetric operations/procedures.

In addition, in the above description of this embodiment, although the present invention has been applied to the fiberboard splice apparatus (that is, for a corrugated medium and a linerboard) on the upstream and downstream sides of a single facer included in a corrugate machine, the invention is not limited to this, but is also applicable to, for example, fiberboard splice apparatus for use in double facers of corrugate machines. In this case, the double facers are for manufacturing various types of double faced corrugated fiberboard such as single wall corrugated fiberboard, double wall corrugated fiberboard and triple wall corrugated fiberboard. The present invention is also applicable to these double facers.

Still additionally, in the above description of the this embodiment, although the present invention has been applied to the fiberboard splice apparatus included in a corrugate machine, the invention is not limited to this, but is widely applicable to, in apparatus for supplying rolled fiberboard continuously, fiberboard splice apparatus which splices new fiberboard to old fiberboard being in supply, for example, for when the rolled fiberboard approaches the used-up state or for when the current rolled fiberboard is replaced with a different type of new rolled fiberboard. Add to it that the construction of the fiberboard part 65 is not limited to the above-described embodiment.

Yet additionally, in the above description of this embodiment, although the fiberboard feed device 8 is composed of a pair of sensors 18, a pair of fingers 15, a pair of cutters 14 and other components for the purpose of handling both the cases in which the roll fiberboard takes not only "the left-hand supply" condition but also the "right-hand supply" condition, if the fiberboard feed device handles only one of the "face-winding" and "back-winding", the fiberboard feed device can be equipped with only the components on one side.

In particular, in the case of the fiberboard splice for roll fiberboard fed as a linerboard, it is preferable that the fiberboard feed device 8 is designed to take the construction according to the above-described embodiment for dealing with both the "face-winding" and "back-winding". On the other hand, for example, in the case of the fiberboard splice of roll fiberboard fed as a corrugated medium, since the "face-winding" and the "back-winding" do not have a significant meaning, each of the lower feed roll, the sensor, the finger, the cutter and others can beat least one in number.

Moreover, the present invention is not limited to the fiberboard splice part included in the fiberboard splice unit 2 according to the above-described embodiment, but it is also acceptable to accomplish the fiberboard splice by adhering one roll fiberboard to an end portion of another roll fiberboard. For example, a gluing device can additionally be provided which applies a glue onto an end portion of a new fiberboard, or puts a pressure sensitive adhesive double coated tape.

Still moreover, although the fiberboard end processing device is provided in the above-described embodiment, for example, in a case in which there is no need to cut off a fiberboard end portion of a roll fiberboard, or in the case of the processing on a corrugated fiberboard sheet made thereafter, this device is not necessary.

Figure 11:
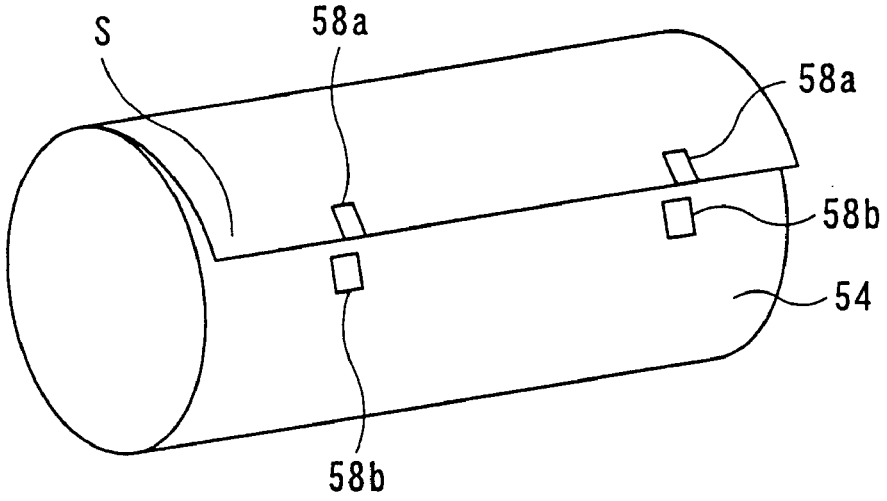
FIG. 11 is an illustrative perspective view useful for explaining disadvantageous points in a case in which a tape is cut through the use of the cutter of the fiberboard splice apparatus according to the embodiment of the invention.

Yet moreover, in the above-described embodiment, as a manner to deal with the tapes 58 which fix the tip portion (fiberboard end S) of the roll fiberboard 54, the tapes 58 are picked up by the finger 15 and the cutter 14 and cut by the cutter 14. However, in this tape removing manner, as shown in FIG. 11, one portion 58*a* of each of the tapes 58 cut off remains on the tip portion of the roll fiberboard 54 while the other portion 58*b* thereof remains on an outer-circumferential surface of the roll fiberboard 54 separated by approximately one turn therefrom.

In general, since the rear surface side (the surface opposite to the adhesive surface) of the tape 58 is made of a smooth material free from the attachment of a glue, if, in manufacturing a corrugated fiberboard sheet, the roll fiberboard 54 is spliced to another roll fiberboard in a state where the tapes 58 (58*a*, 58*b*) remain on the surface thereof, a glue does not stick onto the rear surface side of the tapes 58, so an adhesion trouble can occur. For this reason, a portion of the uppermost layer of the roll fiberboard 54, corresponding to one turn (the length corresponding to one turn of the roll fiberboard 54 from its tip portion) is cut off and removed in the usual way. However, since this leads to a loss of material, preferably, the tapes 58 are peeled, without being cut, so that the tape portions 58*b* do not remain on the surface of the roll fiberboard 54.

Thus, it is considered that each of the tapes 58 is peeled as stated in the following (1) and (2).

Figure 12A:
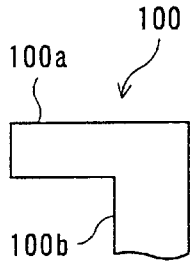
FIG. 12A is a plan view illustratively showing a peeling nail forming a first modification of a pickup member of the fiberboard splice apparatus according to the embodiment of the invention.
Figure 12B:
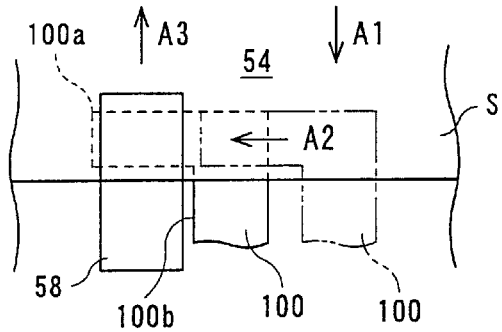
FIG. 12B is a plan view illustratively showing the peeling nail forming the first modification of the pickup member of the fiberboard splice apparatus according to the embodiment of the invention, and showing a state where the peeling nail is positioned under a roll fiberboard (under a tape)

(1) For example, as FIGS. 12A and 12B show, in place of the cutter 14 in the above-described embodiment, a peeling nail (pickup member) 100 having a hook (key) portion 100*a* is placed at a tip side portion touchable on an outer circumferential surface of the roll fiberboard 54 to pick up the tip portion (fiberboard end S) of the roll fiberboard 54 for peeling the tape 58. The other construction and fiberboard splice method are similar to those in the above-described embodiment.

The length of the hook portion 100*a* can be set to be approximately equal to the width of the tape 58 to be used for fixing the end portion of the roll fiberboard 54, as shown in FIG. 12B.

Furthermore, when the tapes 58 are peeled by using the peeling nail 100, the roll fiberboard 54 is first rotated in a direction indicated by an arrow A1 in FIG. 12B (in the rotating direction taken in feeding the roll fiberboard 54), and the tip side hook portion 100*a* of the peeling nail 100 is put under the fiberboard end portion S and between the plurality of tapes 58 attached to the fiberboard end portion S as indicated by a two-dot chain line.

Secondly, in this state, the peeling nail 100 is shifted (see an arrow A2) in an axial direction of the new roll fiberboard 54 (that is, in the web cross direction) by means of a peeling nail actuator (in the above-described embodiment, called the cutter actuator; pickup member actuator) 16 so that the hook portion 100*a* of the peeling nail 100 is positioned under the tapes 58 fixing the tip portion (fiberboard end portion S) of the roll fiberboard 54 as shown in FIG. 12B.

Following this, in this state, the roll fiberboard 54 is rotated in the direction indicated by an arrow A3 in FIG. 12B (in the direction opposite to the rotating direction taken in feeding the roll fiberboard 54), so the hook portions 100*a* peel the tapes 58 off the surface of the roll fiberboard 54.

Accordingly, the fiberboard splice apparatus is made up of a fiberboard detection sensor 60 for detecting the roll fiberboard 54 picked up by the peeling nail 100, a peeling nail actuator 16 for moving the peeling nail 100 in the axial direction of the roll fiberboard 54, a lower feed roll actuator 43 for rotating the lower feed roll 11, and a controller (control means) 40 for outputting control signals to operate the peeling nail actuator 16 and the lower feed roll actuator 43.

In addition, the controller (control means) 40 outputs a signal to the lower feed roll actuator 43 for stopping the rotation of the lower feed roll 11 when the fiberboard detection sensor 18 has detected the roll fiberboard 54, and further outputs a signal to the peeling nail actuator 16 for shifting the peeling nail 100 toward under the tapes 58, and even outputs a signal to the lower feed roll actuator 43 for rotating the lower feed roll 11 in the reverse direction in the state where the peeling nail 100 lies under the tapes 58, thereby peeling the tapes 58.

Therefore, the tapes 58 are peeled by the peeling nail 100 without being cut; in consequence, the tapes 58 remain at the tip portion (fiberboard end portion S) of the roll fiberboard 54 while the tapes 58 (58*b*) are not left on the surface of the roll fiberboard 54.

Accordingly, unlike the above-described embodiment, there is no need to cut off the roll fiberboard (new fiberboard) 54, for example, by a length corresponding to one turn thereof from its tip portion, but it becomes possible to cut off the roll fiberboard 54 by a predetermined length (corresponding to the length of the tape 58 adhered to the tip portion of the roll fiberboard 54) from the tip portion thereof, which reduce the loss of material.

Incidentally, it is also appropriate that the peeling nail 100 is constructed such that an edge portion 100*b* constituting the side surface thereof (the side surface on the side to which the hook portion 100*a* extends) is formed into a sharp knife edge. Thus, the peeling nail 100 can also be used to cut the tapes 58 as well as the cutter 14 in the above-described embodiment. This provides a choice between the cutting of the tapes 58 and the peeling thereof on the basis of the conditions such as the type of fiberboard.

Figure 13A:
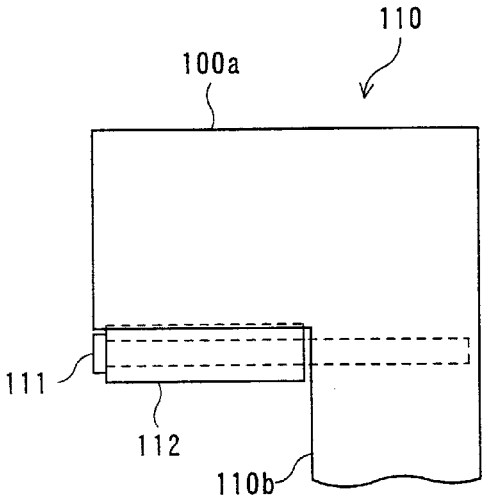
FIG. 13A is a plan view illustratively showing a peeling nail forming a second modification of a pickup member of the fiberboard splice apparatus according to the embodiment of the invention.
Figure 13B:
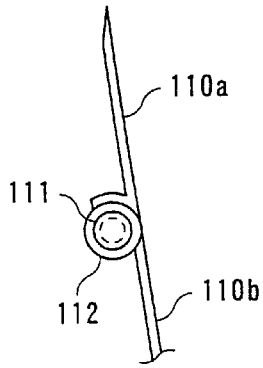
FIG. 13B is a side elevational view illustratively showing the peeling nail forming the second modification of the pickup member of the fiberboard splice apparatus according to the embodiment of the invention.

(2) Furthermore, in place of the cutter 14 in the above-described embodiment, there is provided a peeling nail (pickup member) 110 having, for example, a construction shown in FIGS. 13A and 13B. This peeling nail 110 has, at its tip portion, a hook portion 110*a* capable of being brought into contact with an outer circumferential surface of the roll fiberboard 54 for picking up the tip portion (fiberboard end portion S) of the roll fiberboard 54 to peel the tapes 58 off and is equipped with a roller 112 fitted rotatably in a state adjacent to one end side of the hook portion 110*a* (a side opposite to the tip side of the hook portion 110*a*). The other construction and the fiberboard splice method are the same as those in the above-described embodiment.

This peeling nail (pickup member) 110 is basically constructed like the peeling nail 100 mentioned in (1) except that the roller 112 is rotatably mounted through a pin 111 on the one end side of the hook portion 110*a* (the side opposite to the tip side of the hook portion 110*a*). This roller 112 is capable of coming into contact with the outer circumferential surface of the roll fiberboard 54 and when the roll fiberboard 54 is put in rotation, is made to be also rotatable accordingly.

This is because, in the case of the peeling nail 100 mentioned above in (1), the adhesion surface of the tape 58 peeled comes into contact with the upper surface of the hook portion 100*a* to easily cause the tape 58 to stick to the hook portion 100*a* of the peeling nail 100 so that the tip portion (fiberboard end S) of the roll fiberboard 54 is pulled by the tape 58 attached to the hook portion 100*a* to cause the roll fiberboard 54 to tear or to cause the tape 58 to be peeled off the tip portion (fiberboard end S) of the roll fiberboard 54 to stick to the hook portion 100*b* of the peeling nail 100.

In this case, since the roller 112 is set in a rotatable condition, even if the tape 58 tends to stick to the peeling nail 110 (has a tendency to adhesion), the rotation of the roller 112 eliminates the sticking of the tape 58 to the hook portion 110*a* of the peeling nail 110, and prevents the tip portion (fiberboard end S) of the roll fiberboard 54 from being pulled by the tape 58 attached to the hook portion 110*a* to tear the roll fiberboard 54 or prevents the tape 58 from being peeled off the tip portion (fiberboard S) of the roll fiberboard 54 to stick to the hook portion 110*b* of the peeling nail 110.

Incidentally, it is also appropriate that, as with the case (1) mentioned above, the peeling nail 110 is such that the edge portion 100*b* constituting the side surface thereof (the side surface on the side to which the hook portion 110*a* extends) is formed into a sharp knife edge. Thus, the peeling nail 110 can also be used to cut the tape 58 like the case of the cutter 14 in the above-described embodiment. This offers a choice between the cutting of the tape 58 and the peeling thereof according to the conditions such as the type of fiberboard.

What is claimed is:

1. A fiberboard splice apparatus comprising:

a fiberboard splice part for adhering an old fiberboard fed from one roll fiberboard to an end portion of a new fiberboard fed from another roll fiberboard to accomplish fiberboard splice therebetween; and a fiberboard feed device for forwarding said new fiberboard, fed by unrolling the other roll fiberboard, to said fiberboard splice part, said fiberboard feed device including:

one fiberboard feed roll placed along an axial direction of the other roll fiberboard to make the other roll fiberboard rotatable in a state brought into contact with a surface of the other roll fiberboard; and a pair of pickup members disposed one on each side of said fiberboard feed roll for picking up a tip portion of the other roll fiberboard while coming into sliding contact with said surface of the other roll fiberboard.

2. A fiberboard splice apparatus according to claim 1, further comprising rocking means for rocking said fiberboard feed roll and said pickup members up to a predetermined position according to an unrolling direction of the other roll fiberboard.

3. A fiberboard splice apparatus according to claim 2, wherein said rocking means includes a rocking frame made rockable, a rocking frame actuator for rocking said rocking frame and a controller for controlling said rocking frame actuator.

4. A fiberboard splice apparatus according to claim 1, further comprising pickup member rocking means for rocking said pickup members independently with respect to said fiberboard feed roll.

5. A fiberboard splice apparatus according to claim 4, wherein said pickup member rocking means includes a pickup member supporting member made rockable, a supporting member actuator for rocking said pickup member supporting member, and a controller for controlling said supporting member actuator.

6. A fiberboard splice apparatus according to claim 4, wherein said pickup member rocking means includes a fiberboard detection sensor for detecting a tip portion of the other roll fiberboard picked up by said pickup member.

7. A fiberboard splice apparatus according to claim 1, wherein said pickup member includes:

a finger having a function to pick up a tip portion of the other roll fiberboard and a function to guide said new fiberboard fed from the other roll fiberboard; and a cutter having a function to pick up said tip portion of the other roll fiberboard and a function to cut a tape used for adhering said tip portion of the other roll fiberboard to a roll outer circumferential surface thereof.

8. A fiberboard splice apparatus according to claim 7, wherein said finger is constructed as a flat-plate-like member extending along a cross direction of the other roll fiberboard, and said cutter is made so that its tip portion has a function to cut said tape and made to be movable in said cross direction of the other roll fiberboard.

9. A fiberboard splice apparatus according to claim 8, further comprising:

a fiberboard detection sensor for sensing a tip portion of the other roll fiberboard picked up by said pickup member;

a cutter actuator for shifting said cutter in a cross direction of the other roll fiberboard;

a fiberboard feed roll actuator for rotating said fiberboard feed roll; and a controller for issuing a control signal for operating each of said cutter actuator and said fiberboard feed roll actuator, said control means, when said fiberboard detection sensor senses the tip portion of said roll fiberboard, issuing a signal to said fiberboard feed roll actuator for stopping the rotation of said fiberboard feed roll and further issuing a signal to said cutter actuator to shift said cutter in a cross direction of the other roll fiberboard for cutting a tape used for adhering a tip portion of the other roll fiberboard to a roll outer circumferential surface thereof.

10. A fiberboard splice apparatus according to claim 1, further comprising:

a fiberboard feed roll actuator for rotationally driving said fiberboard feed roll; and a clutch made to establish connection and disconnection of a driving force from said fiberboard feed roll actuator.

11. A fiberboard splice apparatus according to claim 1, further comprising:

a pair of roll supporting frames for supporting said fiberboard feed roll at their end portions; and guide members fixedly secured to said roll supporting frames to guide, to said fiberboard splice part, the other roll fiberboard picked up by said pickup member.

12. A fiberboard splice apparatus according to claim 1, further comprising:

a tape detection sensor for detecting the presence of a tape used for adhering a tip portion of the other roll fiberboard to a roll outer circumferential surface thereof;

a fiberboard feed roll actuator for rotating said fiberboard feed roll; and a controller for outputting a control signal for operating said fiberboard feed roll actuator, said controller, when the presence of said tape is sensed by said tape detection sensor, driving said fiberboard feed roll actuator to set a rotational speed of said fiberboard feed roll at a value lower than a predetermined rotational speed.

13. A fiberboard splice apparatus according to claim 1, further comprising a fiberboard end processing device for cutting the new fiberboard, fed by said fiberboard feed device, by a predetermined length from its tip portion.

14. A fiberboard splice apparatus according to claim 1, further comprising a tape adhering device for adhering a pressure sensitive adhesive double coated tape onto an end portion of the new fiberboard.

15. A corrugate machine comprising a fiberboard splice apparatus according to claim 1.

16. A fiberboard splice apparatus comprising:

a fiberboard splice part for adhering an old fiberboard fed from one roll fiberboard to an end portion of a new fiberboard fed from the other roll fiberboard to accomplish fiberboard splice therebetween; and a fiberboard feed device for forwarding said new fiberboard, fed by unrolling the other roll fiberboard, to said fiberboard splice part, wherein said fiberboard feed device includes:

one fiberboard feed roll placed along an axial direction of the other roll fiberboard; and a pair of pickup members disposed one on each side of said fiberboard feed roll for picking up a tip portion of the other roll fiberboard;

a fiberboard feed roll actuator for rotationally driving said fiberboard feed roll, and a controller for controlling said fiberboard feed roll actuator, said fiberboard feed roll being rotated by said fiberboard feed roll actuator in accordance with a control signal from said controller for fiberboard feeding in a state where said fiberboard feed roll and said pickup member are brought into contact with a surface of the other roll fiberboard.

17. A fiberboard feed method of feeding a new fiberboard to a fiberboard splice part for adhering an old fiberboard fed from one roll fiberboard to an end portion of said new fiberboard fed from the other roll fiberboard to accomplish fiberboard splice therebetween, said method comprising:

a first step of rocking one fiberboard feed roll and a pair of pickup members, disposed one on each side of said fiber board feed roll according to an unrolling direction of the other roll fiberboard and of rocking said pickup member independently of said fiberboard feed roll; and a second step of picking up a tip portion of the other roll fiberboard to feed said tip portion to said fiberboard splice part while rotating the other roll fiberboard through the use of said fiberboard feed roll in a state where said fiberboard feed roll and said pickup member are brought into contact with a surface of the other roll fiberboard.

18. A fiberboard feed method according to claim 17, wherein said first step includes:

in a case in which the other roll fiberboard is in a face-winding condition in which fiberboard is wound in a state where its fiberboard face appears on an outer surface thereof bring said fiberboard feed roll into contact with a surface of the other roll fiberboard so that said fiberboard feed roll reaches a first position and bring said a tip portion of one of said pickup members into contact with said surface of the other roll fiberboard; while in the case in which the other roll fiberboard is in a back-winding condition in which fiberboard is wound in a state where its fiberboard back appears on an outer surface thereof, bring said fiberboard feed roll into contact with a surface of the other roll fiberboard so that said fiberboard feed roll reaches a second position different from said first position and bring a tip portion of the other pickup member into contact with said surface of the other roll fiberboard.

19. A fiberboard feed method according to claim 17, wherein said second step includes, in a state where the other roll fiberboard is picked up, cutting a tape used for adhering said tip portion of the other roll fiberboard to a roll outer circumferential surface thereof.

* * * * *